US005291957A

United States Patent [19]

Curlett

[11] Patent Number: 5,291,957

[45] Date of Patent: Mar. 8, 1994

[54] METHOD AND APPARATUS FOR JET CUTTING

[75] Inventor: Harry B. Curlett, Dallas, Tex.

[73] Assignee: CCore Technology and Licensing, Ltd., Dallas, Tex.

[21] Appl. No.: 38,994

[22] Filed: Mar. 29, 1993

Related U.S. Application Data

[63] Continuation of Ser. No. 849,194, Mar. 11, 1992, abandoned, which is a continuation of Ser. No. 577,501, Sep. 4, 1990, Pat. No. 5,199,512.

[51] Int. Cl.[5] ..... E21B 7/18; E21B 10/60

[52] U.S. Cl. ..... 175/67; 175/393; 175/418; 175/424; 299/81

[58] Field of Search ..... 175/40, 50, 67, 69, 175/70, 329, 393, 418, 424; 299/81

[56] References Cited

U.S. PATENT DOCUMENTS

| | | | |
|---|---|---|---|
| 2,815,248 | 12/1948 | O'Brien | 299/114 |
| 3,112,800 | 12/1963 | Bobo | 175/67 |
| 3,251,424 | 5/1966 | Brooks | 175/56 |
| 3,324,957 | 6/1967 | Goodwin et al. | 175/67 |
| 3,326,473 | 6/1967 | Wahlin | 239/468 |
| 3,385,386 | 5/1968 | Goodwin et al. | 175/422 |
| 3,389,759 | 6/1968 | Mori et al. | 175/258 |
| 3,414,070 | 12/1968 | Pekarek | 175/393 |
| 3,417,829 | 12/1968 | Acheson et al. | 175/67 |
| 3,424,255 | 1/1969 | Mori et al. | 175/60 |
| 3,469,642 | 9/1969 | Goodwin et al. | 175/393 |
| 3,528,704 | 9/1970 | Johnson | 299/14 |
| 3,542,142 | 11/1970 | Hasiba et al. | 175/67 |
| 3,545,552 | 12/1970 | Angona | 175/65 |
| 3,548,959 | 12/1970 | Hasiba | 175/393 |
| 3,603,410 | 9/1971 | Angona | 175/65 |
| 3,838,742 | 10/1974 | Juvkam-Wold | 175/380 |
| 4,125,226 | 11/1978 | Nieuwkamp | 239/468 |
| 4,131,236 | 12/1978 | Saunders | 239/589 |
| 4,174,759 | 11/1979 | Arbuckle | 175/67 |

(List continued on next page.)

FOREIGN PATENT DOCUMENTS 482911 1/1970 Switzerland .

OTHER PUBLICATIONS

Recter et al., "Extending VSP to 3-D and MWD," *Oil and Gas Journal*, Jun. 19, 1989, pp. 55–58.

Dickenson et al., "Conical Water Jet Drilling," *Proceedings of the Fourth U.S. Water Jet Conference*, pp. 89–96 Aug. 28 1987.

Killalea, "High Pressure Drilling System Triples ROPS, Stymies Bit Wear," *Drilling*, Mar./Apr. 1989, pp. 10–12.

Sneddon et al., "Recent Advances in Polycryalline Diamond (PCD) Technology, etc.", *Society of Petroleum Engineers*, 1987, pp. 487–498.

Geier et al., *Water Jet-Assisted Drag Bit Cutting in Medium Strength Rock*, 1987.

*Primary Examiner*—Terry Lee Melius

*Attorney, Agent, or Firm*—Johnson & Gibbs

[57] ABSTRACT

A high-speed fluid/mechanical Jet erosion system utilizing a high-velocity, spinning jet stream discharged contiguous the surface to be cut. The spinning jet stream is developed from a tangentially driven vortex flow system adapted to merge and enhance the erosive high-speed fluid jet characteristics of fluid and abrasive particle impingement erosion with cavitational collapse erosion in both axial and tangential directions. The system further includes an apertured mechanical cutting element which places the exiting spinning jet immediately against the target formation, providing maximum mechanical and fluid energy transfer to the formation. In this manner, the system induces formation fracturing by assisting mechanically induced fracture propagation with the high-speed jet action while simultaneously exploiting high-speed jet erosion-induced kerfs with the mechanical action of the tool.

44 Claims, 14 Drawing Sheets

U.S PATENT DOCUMENTS

| | | | |
|---|---|---|---|
| 4,185,706 | 1/1980 | Baker, III et al. | 175/340 |
| 4,244,521 | 1/1981 | Guse | 239/110 |
| 4,262,757 | 4/1981 | Johnson, Jr. et al. | 175/67 |
| 4,280,735 | 7/1981 | Lobbe | 299/81 |
| 4,306,627 | 12/1981 | Cheung et al. | 175/422 |
| 4,337,899 | 7/1982 | Selberg | 175/424 |
| 4,359,115 | 11/1982 | Cagnioncle | 175/393 |
| 4,389,071 | 6/1983 | Johnson, Jr. et al. | 299/14 |
| 4,391,339 | 7/1983 | Johnson, Jr. et al. | 175/393 |
| 4,474,250 | 10/1984 | Dardick | 175/50 |
| 4,474,251 | 10/1984 | Johnson, Jr. | 175/67 |
| 4,534,427 | 8/1985 | Wang et al. | 175/67 |
| 4,542,798 | 9/1985 | Madigan | 175/340 |
| 4,610,321 | 9/1986 | Whaling | 175/67 |
| 4,624,327 | 11/1986 | Reichman | 175/67 |
| 4,660,773 | 4/1987 | O'Hanlon | 239/596 |
| 4,664,314 | 5/1987 | O'Brien et al. | 239/469 |
| 4,681,264 | 7/1987 | Johnson, Jr. | 239/589.1 |
| 4,687,066 | 8/1987 | Evans | 175/340 |
| 4,694,916 | 6/1987 | Ford | 175/249 |
| 4,694,918 | 9/1987 | Hall | 175/329 |
| 4,723,612 | 2/1988 | Hicks | 175/393 |
| 4,733,735 | 3/1988 | Barr et al. | 175/393 |
| 4,759,415 | 7/1988 | Pessier | 175/340 |
| 4,765,687 | 8/1988 | Parrott | 299/81 |
| 4,787,465 | 11/1988 | Dickinson, III et al. | 175/67 |
| 4,852,668 | 8/1989 | Dickinson, III et al. | 175/67 |
| 4,858,707 | 8/1989 | Jones et al. | 175/329 |
| 4,902,073 | 2/1990 | Tomlinson et al. | 299/81 |

OTHER PUBLICATIONS

Maurer et al., "Laboratory Testing of High Pressure, High-Speed PDC Bits," *Society of Petroleum Engineers SPE*15615, 1986.

Mazurkiewicz et al., "A Model Study of the Water Pressure, etc.," International Symposium on Jet Cutting Technology, Paper 18, Sep. 1986, pp. 189–193.

Deily et al., "Five Wells Test High Pressure Drilling," *The Oil and Gas Journal*, Jul. 4, 1977, pp. 74–81.

Crow, "The Effect of Porosity on Hydraulic Rock Cutting," *Int. J. Rock Mech. Min. Sci. + Geomech Abstr.*, vol. 11, pp. 103–105, 1974.

Feenstra et al., "Tests show jet drilling has promise," *The Oil and Gas Journal*, Jul. 1, 1974, pp. 45–57.

Chanaud, "Experiments Concerning the Vortex Whistle," 1963, pp. 953–960. Acoustical Society of America, J. Acoust. Soc. Am.

56
58
Vc
V
Pmin
54
r
Pi

Vc
V
8
57
58
9
7

65
57
58
62
56
60
54
52

Pi
60
56
65
54
52

METHOD AND APPARATUS FOR JET CUTTING

This is a continuation of application Ser. No. 07/849,194, filed Mar. 11, 1992 (now abandoned) which is a continuation of application Ser. No. 07/577,501, filed Sep. 4, 1990 (now U.S. Pat. No. 5,199,512).

BACKGROUND OF THE INVENTION

1. Field of the Invention

The present invention relates to jet cutting systems and, ore particularly, to a method of and apparatus for producing an erosive cutting jet stream for drilling, boring and the like.

2. History of the Prior Art

The prior art is replete with designs for mechanical cutting systems used to break, fracture and/or shear formations for the penetration thereof. Examples of such systems include modern-day drill bits of the type used for drilling deep well bores for the oil and gas industries. The most critical problem associated with the mechanical cutting of formations is untimely stress corrosion or thermal degradation failure of the materials used as the cutting means. Such material failure limits the ability of the operator to transfer high mechanical energy to the mechanical cutters. These problems create financial as well as physical limitations for commercially available drilling systems. In essence, the subterranean formation must be capable of cost effective penetration, which requires efficient energy transfer.

The search for a more efficient energy transfer system has resulted in a number of recent inventions and developments in drilling, boring and cutting systems. For example, the development of hydraulic erosion jetting mechanisms has, over the last 50 years, been the subject of increased interest. This design direction is due to the attributes of hydraulic erosion jetting, which include more efficient energy conversion to the work surface and a potentially ideal working medium, typically water, which is in great abundance and therefore economically expendable. Moreover, the technique is conceptually simple.

Hydraulic erosion of earthen formations is a technology that has been analyzed and reported in numerous publications. The erosion takes place by employing various failure mechanisms of the work surface induced by action of the liquid jet. The types of failure mechanisms that have been reported include; (1) failure of porous rock due to stress induced through liquid filled pore spaces of the rock brought about by impacting the liquid contained in the pore space; (2) formation failure by crack propagation and/or extension due to hydraulic fracture forces occurring when a liquid filled fracture is forced to close after an initial mechanical force is released; (3) liquid jet droplet impingement that erodes the cementation between formation grains thereby loosening and dislodging the harder formation grains. This last stated technique is known as Soft Erosion and is the typical mechanism present when eroding formations where the impinging jet stagnation pressures do not exceed the threshold pressures required to fracture the rock and thereby force large scale permeability in the in situ formation.

Other types of formation failure include (4) droplet impingement, known as Hard Erosion, that fractures the rock grains and the cementation by exceeding the threshold pressures necessary to fracture the formation grains and force large scale permeability by breaking the individual grains away from the formation; and (5) liquid Jet induced pressure reversals that allow the in situ formation pore pressures to force tensile failure of the cementation holding rock grains together.

Prior art investigations and applications of erosive jet cutting have shown that liquid jets can be very effective in eroding rocks. The investigations have covered the broad modes of jet operation classed as continuous jets, interrupted jets, cavitating jets and abrasive particle jets. In each broad category there are a multiplicity of variations of the jets that have been investigated to focus on a predominant operational feature of the j et mode. Examples of these investigations are found in the following articles: "Tests Show Jet Drilling Has Promise", Feenstra, R., et al, The Oil and Gas Journal, Jul. 1, 1974, "The Effects of Porosity on Hydraulic Rock Cutting", Crow, S. C., International Journal of Rock Mechanics, Mining, Science & Geomechanics Abstract, Vol. 11, pp. 103–105. Pergamon Press 1974 and "A Model Study of the Water Pressure Distribution in a Crack when Impacted by a High Pressure Water Jet", Mazurkiewicz, Dr. M. et al, 8th International Symposium on Jet Cutting Technology, Durham, England: 9–11 September, 1986. In addition, references to cavitation and particle abrasion, respectively, may be seen in the following articles: "The Development of Structured Cavitating Jets for Deep-Hole Bits" by Virgil E. Johnson, Jr., Georges L. Cahine, William Lindenmuth, Andrew F. Carr and Gary S. Frederick, Hydronautics, Incorporated and George J. Giacchino, Jr. NL/HYCALOG/NL Industries, Inc. , Society of Petroleum Engineers or AIME Paper 11060, 1982; and "New Gulf Method of Jetted-Particle Drilling Promises Speed and Economy," *The Oil and Gas Journal* Jun. 21, 1971.

A number of problems are associated with erosive jet cutting systems. One of the problems that limits the optimum performance of the jet has been the inability to provide reliable means for maintaining a specific distance between the jet nozzle and the target formation. In prior art designs, it has been deemed necessary to control the distance between the nozzle and the target formation in order to properly focus the energy of the jet streams. In order to address this problem, most nozzles have been recessed from the cutting surface by several nozzle diameters in order to allow the nozzle to survive the rigors of the cutting environment while others have been recessed to allow maturation of the erosive jet mode to develop. It has been noted, however, that the splash back erosion against the tool caused by the jet action then becomes a serious problem. Additionally, there is typically an exponential energy decay with increased standoff distances. A number of prior art patents have addressed these various concerns, and the teachings of these patents are illustrative of several problems in erosive cutting jet systems.

U. S. Pat. No. 4,787,465, entitled Hydraulic Drilling Apparatus and Method, is a 1988 patent teaching a drilling apparatus producing a whirling mass of pressurized cutting fluid to create a high-velocity cutting jet. The cutting action is enhanced by abrasive material in the drilling fluid. This technology is further discussed in U.S. Pat. No. 4,852,668, which is a 1989 patent issued to the same inventors. The cutting nozzles disclosed in these patents employ an axial conical spray that predominantly uses the development of a thin sheet of high speed liquid drops that develop within the conical spray and erode through liquid drop impingement of the target formation granule cementation and thereby dislodge formation grains as discussed above. These grains are then carried into a reentry torodial flow motion, which is perpendicular to the axis of the conical spray, that further uses the grains for an in situ abrasive to abrade and dislodge further particles. The stated purpose of this conical jet is to hydraulically drill a hole of a diameter larger than the drill head and its supply/transport tube without rotating the system. This aspect is more fully set out in the article "Conical Water Jet Drilling", Dickenson, W. et al, Proceedings of the Fourth U.S. Water Jet Conference.

Various attempts to combine the positive aspects of mechanical cutting means and hydraulic erosion jetting means have also been reported. Several references may be seen in "Five Wells Test High-Pressure Drilling", Deily, F. H. et al, The Oil and Gas Journal, Jul. 4, 1977; "Laboratory Testing of High Pressure, High Speed PDC Bits"—W. C. Maurer and W. J. McDonald, Maurer Engineering, Inc.; J. H. Cohen, Drilling Research Center, Inc.; J. W. Neudecker Jr., Los Almos National Laboratory; and D. W. Carroll, U.S. Air Force—SPE Paper 15615, "Water-Jet-Assisted Drag Bit Cutting in Medium-Strength Rock", Geier, J. E. et al, United States Department of the Interior Information Circular 9164 and "High Pressure Drilling System Triples ROPS, Stymies Bit Wear" Mike Killalea, Editor—Drilling, March/April 1989.

Additional development efforts in combining mechanical cutting and hydraulic erosion Jetting means are seen in U.S. Pat. No. 3,838,742 issued to Juvkam-Wold and U. S. Pat. No. 4,391,339 issued to Johnson. The Juvkam-Wold patent teaches the use of a fluid/mechanical system incorporating abrasive resistant nozzles recessed in a mechanical drill bit adapted for discharging a high velocity stream of abrasive laden liquid through the nozzles. The Johnson patent teaches an improved technique utilizing recessed nozzles adjacent mechanical cutting surfaces, wherein the nozzles discharge a cavitating liquid jet. This patent, which references the Juvkam-Wold patent, further teaches one technique of maintaining a controlled distance between the cavitating jet nozzles and the surface to be cut by using exposed diamond wear buttons and a pre-select nozzle recess distance wherein maximum cavity collapse is said to occur. The recess also serves an apparent purpose of protecting the nozzle. A further discussion of the use of structured shedding vortex rings created in the shear zone between the jet and the spent liquid in the hole, wherein vapor cavities are formed, may also be seen. The application of vortex ring cavitation has thus been recognized to be effective in such fluid/mechanical cutting systems.

As referenced above, the combination of high speed fluid jet cutting in mechanical drilling systems has clearly been the subject of continued development for cutting systems. This type of combination has been shown to demonstrate superior efficiencies when compared to purely hydraulic erosion drilling means. However, a number of problems still plague the industry, which problems prevent a reliable and efficient high-speed cutting jet. It would be an advantage, therefore, to utilize the positive aspects of high-speed jet cutting in a fluid/mechanical system that is both reliable and devoid of the critical problems of the prior art. The present invention provides such a system by utilizing a high-speed spinning jet stream developed from a tangentially driven vortex flow system which merges the erosive high-speed fluid jet characteristics of fluid impingement erosion, abrasive particle impingement erosion and cavitational collapse erosion in both an axial and tangential direction.

SUMMARY OF THE INVENTION

The present invention pertains to methods of and apparatus for high-speed fluid Jet cutting. More particularly, one aspect of the present invention relates to a method of eroding a solid surface with a high velocity, swirling liquid jet comprising the steps of forming a high velocity, swirling liquid Jet and providing a wear button adapted for engaging the solid surface for the eroding thereof. An aperture is formed though the wear button and the high velocity, swirling liquid jet is discharged from the wear button aperture against the solid surface. The jet may be formed by a tangential or involuted injection of liquid into a substantially cylindrical chamber. The tangentially swirling liquid may be discharged from a centrally disposed orifice positioned in flow communication with the cylindrical chamber to form a swirling liquid jet, wherein the jet may be moved relative to the solid surface. In this manner, fracture propagation may be mechanically induced in the solid surface.

In another aspect, the invention includes an improved method of eroding a solid surface with a high velocity liquid jet of the type wherein the liquid jet is formed for impingement against the solid surface. The improvement comprises the steps of forming the jet by tangential injection of liquid into a substantially cylindrical cavity formed in a housing and discharging the tangentially swirling liquid from a centrally disposed orifice coupled to the cylindrical cavity. The housing and orifice therein is positioned against the formation to be cut for discharging the swirling liquid therein. In one aspect, the method further includes the step of mechanically inducing fractures and the propagation thereof in the eroded region with the housing. In another aspect, the invention includes providing an abrasion resistant discharge nozzle and disposing the discharge nozzle outwardly of the housing and onto the formation to be eroded. The method also includes the step of introducing an abrasive stream into the center of the liquid jet vortex, the abrasive stream being either gaseous or liquid.

In yet another aspect, the invention includes an improved tool for the erosion of a formation wherein the improvement comprises a tool body having a plurality of discharge orifices disposed therearound and a plurality of jet nozzles disposed within the discharge orifices. In one embodiment the nozzles are constructed to protrude from the tool body. A generally cylindrical chamber is formed in the tool body and disposed in flow communication with the nozzles. Means are then provided for injecting high pressure liquid into the cylindrical nozzle chambers for creating a vortex swirl therein. The vortex swirl is then discharged through the nozzles adjacent the formation. The swirl may be formed by tangential or involuted injection or by a stator configuration which induces the liquid to swirl.

In a further aspect, the invention includes apparatus for eroding a solid surface with a swirling liquid jet comprising a housing adapted for movement relative to the surface and a plurality of liquid jet nozzles mounted in the housing and adapted for the discharge of the swirling liquid jet therefrom. The nozzles include a discharge member extending outwardly from the housing, the discharging member having an aperture formed therethrough adapted for the discharge of the swirling liquid jet and means for generating a high velocity swirling liquid Jet therefrom. Means are also provided for moving and/or rotating the housing relative to the surface to be eroded.

In another aspect the invention includes the apparatus as set forth above wherein the swirl generating means includes a generally cylindrical chamber disposed within the housing and means for the tangential or involuted injection of fluid into the chamber for the generation of a swirling flow therein. Means are provided for the egress of the swirling liquid from the chamber. The egress means comprises a generally conical recess formed in the discharge member contiguous the chamber, the conical recess being disposed in axial flow communication with the central aperture formed therethrough. The discharge member may also be constructed as an elongate wear button having an aperture formed therethrough and adapted for extending outwardly from the housing into engagement with the surface to be eroded.

In another aspect, the invention includes the liquid vortex-induced spinning jet stream described above and constructed to produce pure tone sound that can be varied as a function of its pressure and flow volume. The pure tone sound generates a sound source that can be used for seismic measurement-while-drilling and electrical logging data generation in select cutting applications utilizing the present invention.

In yet another aspect, the present invention relates to a system for eroding a solid surface with a high speed liquid jet generated by a high speed liquid flow introduced tangentially into a swirl generating chamber having a centrally located flow exit tube of reduced diameter which forms an exiting nozzle from which emerges a multi-component high speed spinning vortex cutting jet. The invention additionally provides for the use of a mechanical cutter to form part of the-swirl generator and exit tube nozzle. The vortex Jet provides improved Jet erosiveness derived from the hydrodynamic interaction of the multi-component vortex flow regimes within the jet and the formation. The use of the mechanical cutter, as a combination nozzle and cutter, places the exiting vortex jet stream immediately adjacent the formation where the energy levels of the vortex jet stream are maximum subsequent to exiting the nozzle. As the nozzle-cutter is mechanically driven into the target formation, the nozzle-cutter mechanically induces stress in the formation that can be further exploited by the high energy levels of the vortex jet stream through further stress increases, abrasion, pressure reversals, cavitation and fracture propagation. As the jet stream continues to flow along the kerf formed by the jet in the formation there are phase changes that take place in the vortex jet stream that exhibit multiple erosive interactions which collectively erode the formation further through abrasion, cavitation and pressure reversals.

BRIEF DESCRIPTION OF THE DRAWINGS

For a more detailed description of the construction and operation of the present invention, reference is now made to the following description taken in conjunction with the accompanying drawings, in which.

DETAILED DESCRIPTION OF THE DRAWINGS

Figure 1:
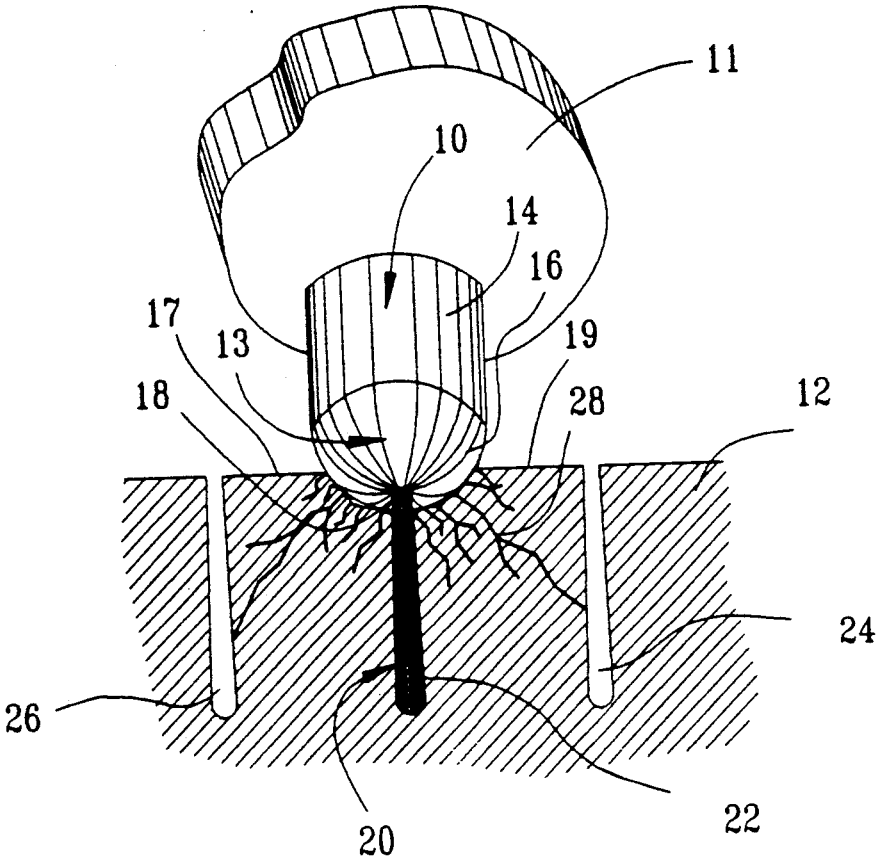
FIG. 1 is a perspective view of a tangentially driven vortex jet tool in engagement with a formation, illustrating the cutting thereof in accordance with the principles of the present invention.

Referring first to FIG. 1, there is shown a fragmentary perspective view of one embodiment of a vortex jet wear nozzle 10 engaging an earthen formation 12 and penetrating said formation in accordance with the principles of the present invention. In this view, a cutting nose 13 of the wear nozzle 10 is shown protruding from a housing 11. The nose 13 includes a generally cylindrical body 14 and a hemispherical head region 16 which is constructed to extend from the support housing 11, such as a drill bit (not shown), for direct engagement of the surface 12 to be eroded. In the center of hemispherical head 16 a discharge aperture 18 is formed therethrough. A high-velocity, vortex jet 20 is therein illustrated being discharged from aperture 18 in deep penetration of the formation 12 creating a kerf, or cut region 22, therein. Open kerfs 24 and 26 are shown adjacent kerf 22. Also shown adjacent the kerf 22 and the hemispherical head 16 of the cutting nose 13 are fracture lines 28, illustrating one aspect of the operation of the wear nozzle 10 of the present invention, which is described in more detail below.

Still referring to FIG. 1, the wear nozzle 10 is constructed to produce a swirling discharge 20 from nose 13 of sufficient velocity and energy to selectively erode the formation 12. Further illustrations of both the erosive action and the vortex stream are provided herein in order to illustrate the methods of and apparatus for the present invention. Before addressing such flow characteristics, however, it is necessary to understand the actual construction of the vortex nozzle 10 as well as the theoretical operation thereof.

Figure 2B:
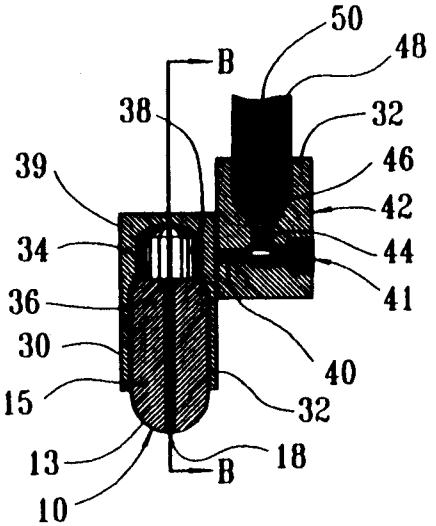
FIG. 2 which consists of FIGS. 2A through 2E are multiple views of one embodiment of the vortex jet nozzle of FIG. 1, illustrating the assembly thereof.
FIGS. 2F and 2G are views of an alternative embodiment of the vortex jet of FIGS. 2E and 2D.
Figure 2A:
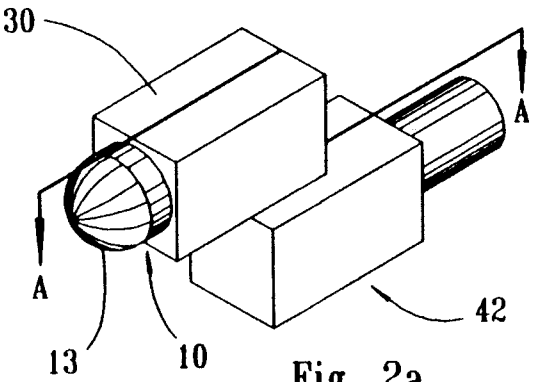

Referring now to FIG. 2A, there is shown a perspective view of one embodiment of the nozzle 10 of the present invention, as it would be assembled in the housing 11 of FIG. 1. The cutting nose 13 is thus seen to depend from wear nozzle housing 30. The wear nozzle housing 30, constructed of stainless steel, or the like, is best shown in FIG. 2B, which is a side elevational, cross-sectional view of the nozzle 10 of FIG. 1, taken along lines A—A thereof. As seen in this side elevational, cross-sectional view of the assembled vortex nozzle 10, housing assembly 30 includes an elongate jet cutter 15, the end of which forms cutting nose 13. The cutter 15 is received within a sleeve 32, of housing 30, in press fit engagement therewith. Cutter 15 can also be engaged in housing 30 by soldering, welding or employing mechanical means other than a press fit. Irrespective of the manner of securement, a discharge aperture 18 is shown to be constructed axially through the cutter 15, terminating at one end in nose 13 and at the other end in an upper feed region 34. In the upper feed region 34, the discharge aperture -18 forms an enlarged funnel region 36, which funnel region 36 is disposed adjacent a generally cylindrical cavity 38 formed within a head region 39 of housing 30. The head 39 is disposed adjacent to adjacent feedblock 42. Feedblock 42 is constructed adjacent sleeve 32 and is constructed with a passage 40 for the passage and tangential injection of liquid into cavity 38, as best illustrated in FIG. 2E. Passage 40 also includes an upstanding port 44, disposed in flow communication with a generally cylindrical recess 46. A tooling access port 41 is shown for reference purposes, as such access would generally be required for drilling the tangential passage 40 as- shown in this particular embodiment. Cylindrical recess 46 has received therein a feedline 48, having a flow passage 50 formed axially therethrough. Liquid carried by feedline 48 thus discharges liquid from passage 50 into port 44 and passage 40 for tangential injection into cavity 38. The manner of tangential entry into cavity 38 and the methods and apparatus thereof will be described in more detail below. Likewise, further description of the nozzle 10, the jet cutter 15, and housing 30 will be described in more detail below after first addressing certain operational principles thereof.

Figures 3A, 3B, 3C, 3D:
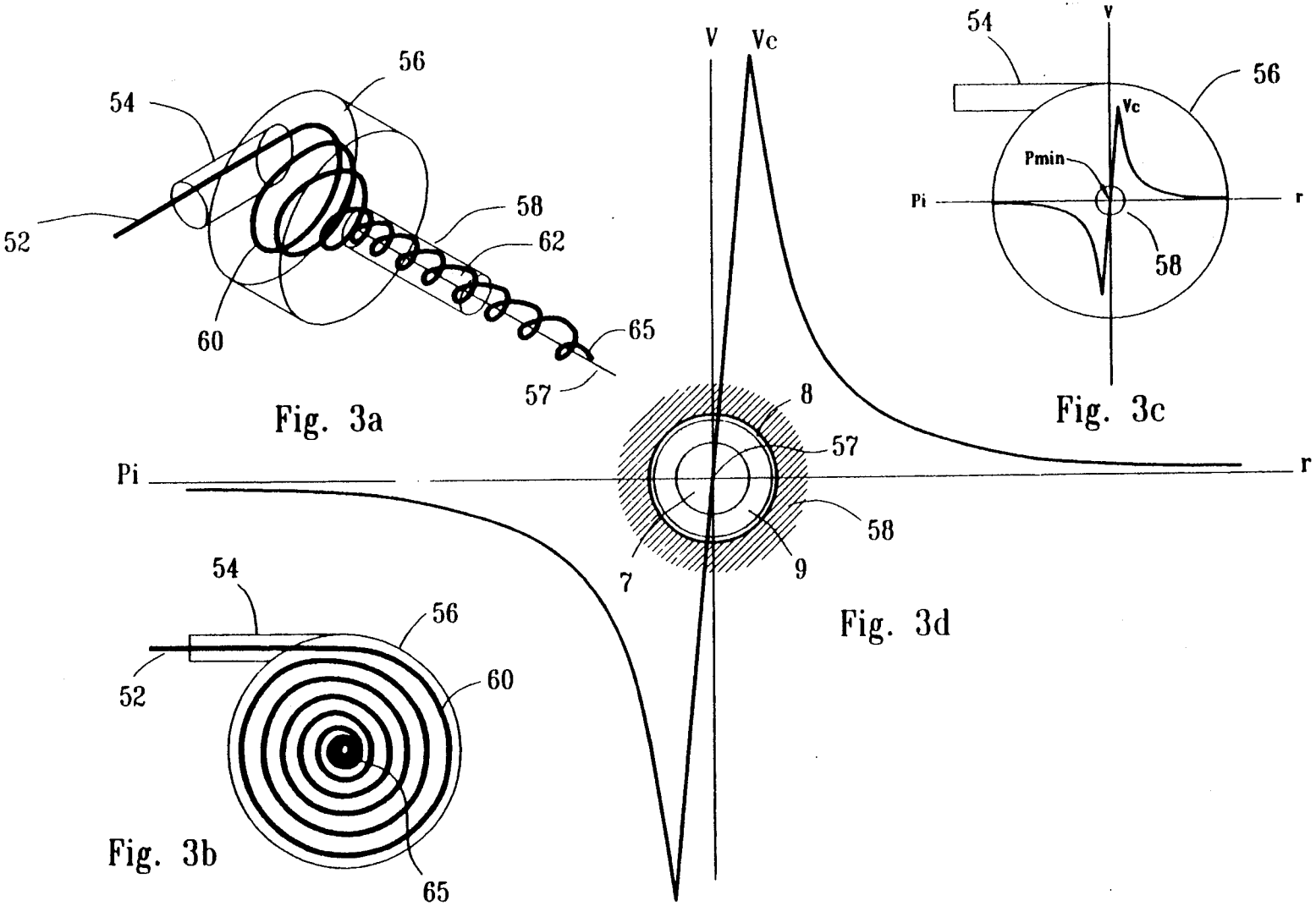
FIG. 3 which consists of FIGS. 3A through 3D are diagrammatical illustrations of the theoretical operation of a vortex generator and jet for the nozzle of FIG. 1, including a pressure/velocity distribution curve therefor.

Referring now to FIG. 3A, there is shown the conceptual components and operation of a device known as a vortex whistle. This device is more fully described by the investigations of Robert C. Chanuad and discussed in the article entitled "Experiments Concerning the Vortex Whistle," by the Acoustical Society of America in 1963. The article describes various relationships of tangentially introduced flow into a swirl chamber, which flow is exhausted through a relatively small diameter exhaust tube. The phenomenon of high-speed vortex flow is a functional component of the present invention. The phenomenon is produced by tangential flow 52, which passes through a tangential supply line 54. The supply line 54 is connected to the swirl chamber 56, which is shown as a generally cylindrical cavity (such as cavity 38 described above). Axially connected to the swirl chamber 56 is a discharge tube 58. As the flow 52 is forced into the swirl chamber 56 and the flow 52 conforms with the swirl chamber configuration, it is continually forced into an ever-decreasing radius of rotational flow as represented by streamlines 60. The swirling flow 52 is further forced along the streamlines 60 until it flows inwardly toward the axis 57 of the exhaust tube 58. Throughout this pattern, the flow 52 increases its angular velocity in accordance with the law of the conservation of angular momentum.

Still referring to FIG. 3A, the flow 52 is subsequently forced into the exhaust tube 58 with the above referenced increased angular velocity. A simplistic description of the flow regime in the exhaust tube 58 is illustrated here as a tight helical flow 62 along the axis 57 of said exhaust tube. Further details of this flow regime will be provided below. As the helical flow 62 exits the exhaust tube 58, the flow 62 has been shown to precess. The flow processing phenomenon has been recognized in various studies. This phenomenon generates a pure vibrational tone with a frequency that is directly related to flow conditions. The frequency of this vibrational tone is approximately equal to the angular velocity of the flow 62 as it nears the exit of the exhaust tube 58. The sound produced will vary directly with fluctuation in flow 52. This is a recognized physical phenomenon as more fully set forth in the above referenced article by Chanuad entitled "Experiments Concerning the Vortex Whistle."As schematically represented in FIG. 13, a variable pure tone sound is produced at a drill bit 405 at the end of a well bore 410. Seismic sensors 415 are placed outwardly of the wellhead 420 and detect the reflected seismic signals 425 generated by the downward travelling tone 400.

Referring now to FIG. 3B, there is shown a top plan view of the vortex whistle of FIG. 3A, illustrating the flow line therein. The flow 52 is thus shown to enter the supply pipe 54 for tangential entry into the swirl chamber 56. The pattern of flow 60 within the swirl chamber 56 is illustrated as a spiral in this Particular view, which spiral terminates in central discharge region 65. The central discharge region 65 is, in actuality, a top plan view of the high-velocity rotational flow 62 described above. At this point it may be seen, however, that the angular velocity of the fluid Will be magnitudes higher than the angular velocity of the fluid adjacent the supply pipe 54.

Referring now to FIG. 3C, there is shown, superimposed on top of a plan view of the swirl chamber 56, a Rankine line-type vortex velocity/pressure profile curve that illustrates spatial velocity and Pressure relationships as a function of radii from the center of the said swirl chamber. The curve presented in FIG. 3C illustrates the premise above described, to wit that the closer one measures parameters of flow toward the center of the swirl chamber, the greater the velocity and pressure of the flow. This is true until a radius is reached, where a core of the rotating fluid acts like a solid rotating body with velocity and Pressure decreasing as a function of a decreasing radius.

Referring now to FIG. 3D, an enlarged view of the Rankine line vortex velocity and pressure curve in spatial relation to the exit tube fluid flow is herein shown. The rotation flow entering the exhaust tube may seem to be conformed into three distinct flow regions: 7, 8 a nd 9. The flow of region 8 is a boundary layer flow and flows in a large helical manner in the axial direction of the exhaust tube 58. The flow region 9 is an annular flow region that exhibits relatively high velocity circumferential flow that has negligible relative movement associated with it in the axial direction of the exit tube 58. The next, innermost region 7 behaves as a solid body core flow field which flows in a helical manner in the axial direction of the exhaust tube 58. Region 7 exhibits the lowest velocities and pressure near its axis 57. The central region of this centermost core has a pressure that will typically drop below the vapor pressure of the liquid under high rotational speed conditions and therefore produce a vaporous cavity which can be either continuous or periodic. This combination of spinning flow regimes stabilizes quickly upon entering the exit tube 58 and will remain intact as flow pattern 65 (FIG. 2C) for a distance beyond the exit tube end at high rotational speeds. The cross-sectional thickness of each region 8, 9 and 7, within the exit tube, will vary with the rotational speed and therefore is also a function of the axial distance from the swirl chamber 56 in FIG. 3A. It is the hydrodynamic effects of these regions of flow that provide the basis for improved erosion of the formation as herein described. The method of use and application of these spinning vortex flow regions and the apparatus to generate this vortex flow in combination with a mechanical cutting means will thus be further described in more detail below.

Figure 4A:
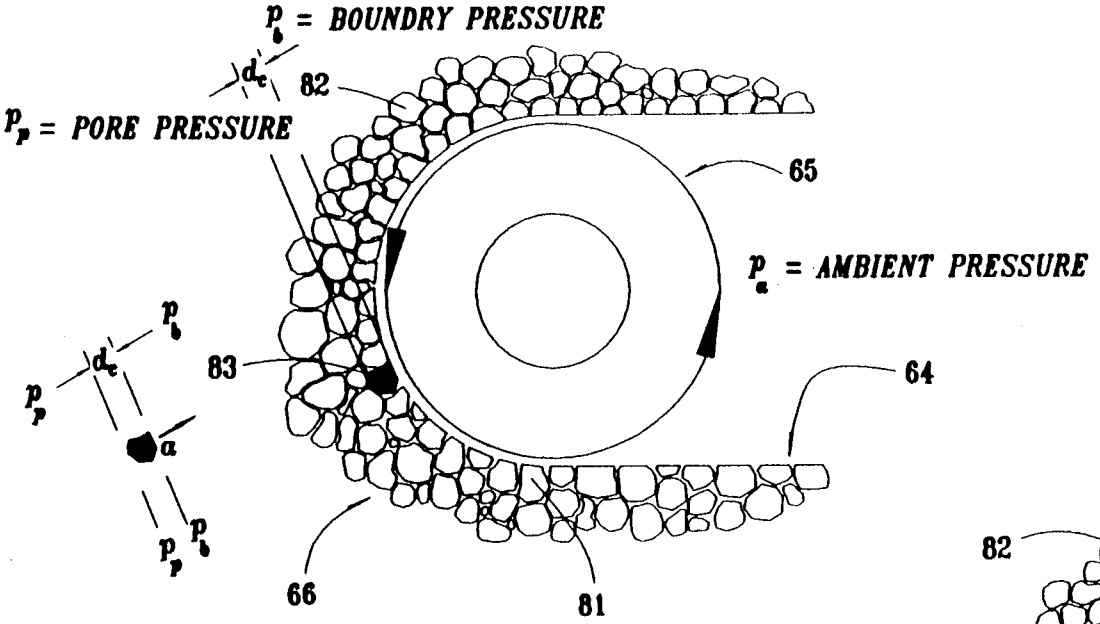
FIG. 4 which consists of FIGS. 4A and 4B are enlarged diagrammatical illustrations of the dynamic erosive effects of the induced hydrodynamic pressure reversals and the dynamic erosive effects of the jet nozzle of FIG. 1 in operation against an earthen formation.

Referring now to FIG. 4A, there is shown an enlarged diagrammatic illustration of a vortex jet stream 65 of the type described above in engagement with an earthen formation 66. The earthen formation 66 is shown to be comprised of cemented grains 82 and Particularly showing representative grains 81 on the boundary of a kerf wall 64 as they are being eroded by the vortex jet stream 65. The boundary layer of formation grains adjacent to and generally forming a semicircle in front of the vortex jet 65 is subjected to a pressure differential caused by low pressure area in the boundary between the vortex jet 65 and kerf wall 64. The pressure differential is relative to the formation pore pressure behind the boundary layer grains on the kerf wall 64. This relationship has been observed and is explained in U.S. Pat. Nos. 4,681,264 and 4,474,251, both issued to Virgil E. Johnson, Jr. As explained in these references, one method of enhancing the erosive intensity of a high-velocity liquid jet for cutting., drilling or otherwise acting on a formation comprises the steps of forming the jet and oscillating the velocity of the jet at a preferred Strouhal number and impinging the pulsed jet against a solid surface to be eroded. It is set forth in the Johnson '251 patent that if a cavitating liquid jet is excited So as to structure itself into discrete vortex rings, normal to the axial direction or the Jet stream, such a liquid jet will cavitate more violently, increasing erosion. Harnessing the pressure differential Over a radially spreading vortex ring as it is impinged and passes over the formation boundary provides for both axial and rotational forces acting to induce directional factors to improve the erosive result.

Figure 4B:
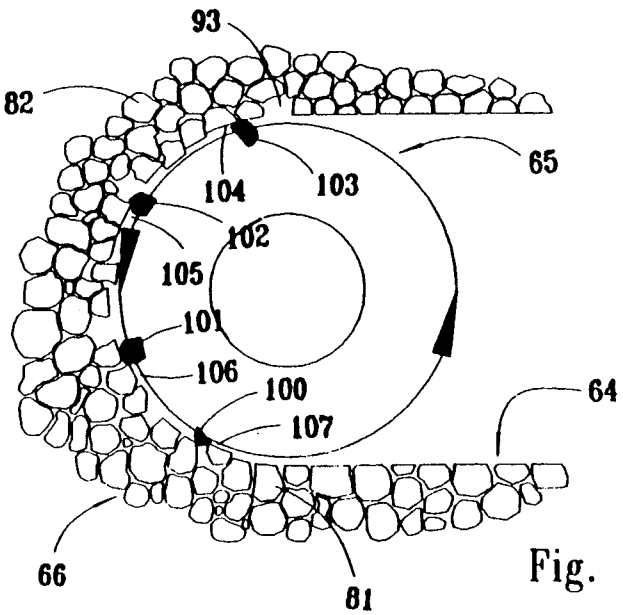

Referring now to FIG. 4B, there is shown an illustration of the expected results of the dislodging of the boundary layer particles due to the combination of rotational and axial flows that exploit the inter-granular cementation stress cracking effected by boundary layer velocity induced pressure differentials. The subsequent entrainment of the dislodged formation grains, as illustrated by grains 100, 101, 102 and 103, are effectively used as an in situ abrasive to further impinge upon and abrade both the intergranular cementation and the grains themselves. A further benefit of the vortex action is the entrainment of the abrasive particles and allowing more abrasion to take place than would occur in a purely axial jet action.

Figure 5:
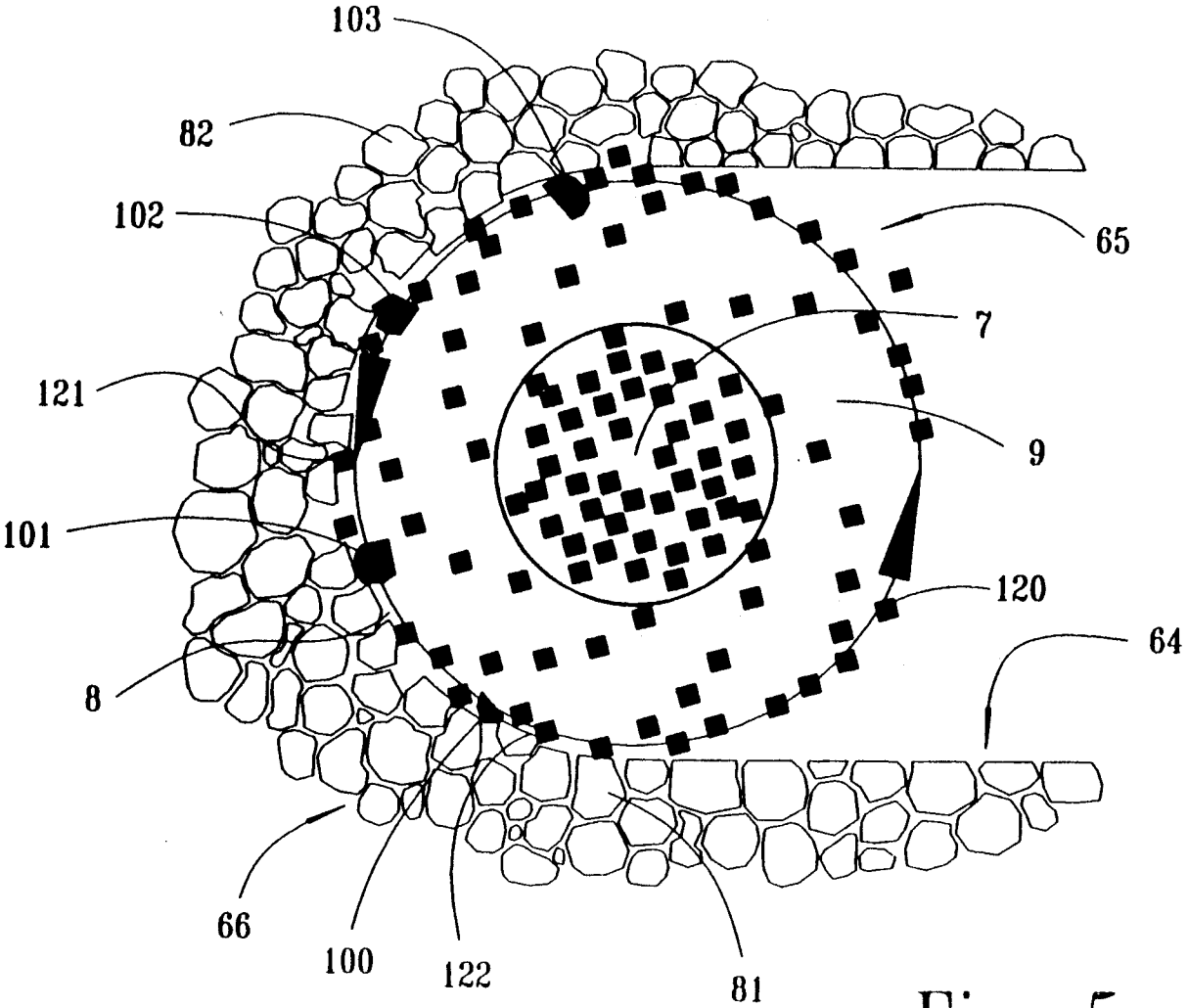
FIG. 5 is a further enlarged view of the dynamic erosive effects of FIG. 4A for a nozzle having a center-fed abrasive particle stream.

Referring now to FIG. 5, there is shown a cross-section of the vortex jet stream 65 with an abrasive particle stream introduced into the center core flow region 7. The abrasive particle stream provides an external source of abrasive material 120 as shown herein. An example of such an apparatus is further illustrated in FIG. 7 described below. As abrasive material particles 120 are centrifugally disbursed from core flow region 7 into flow region 9, they become entrained in the vortex jet action of flow region 9. Here abrasive particles 120 pick up energy and are subsequently impinged against the formation 66. Another benefit of the vortex action is the longer entrainment of the abrasive particles, such as silica flour, due to the rotational motion of the vortex jet which tends to provide a longer duration of single particle abrasion to take place than would occur in a purely axial jet action. Such a mechanism for supplying abrasive material into a fluid jet will be useful in many applications of material cutting.

As described above, the benefit of the vortex jet action is that it allows the introduction of a lower pressure abrasive slurry into the focused jet stream to increase its cutting effectiveness without causing unacceptable erosion of the delivery equipment. Such a problem plagues prior art abrasive jet cutting systems. Moreover, the concept of injecting abrasives into the central region of the vortex jet can be utilized in various modes. For example, a high pressure axial jet can be additionally focused for a greater distance from a nozzle exit by shrouding it with a liquid or gaseous co-axial vortex. Also, when cutting a porous material that is sensitive to liquid invasion, a gaseous vortex jet with a gaseous co-axial abrasive jet stream could be employed. As can be seen, there are many adaptations for using liquids, gases, combination of both, independently or combined with abrasive material.

Figure 6B:
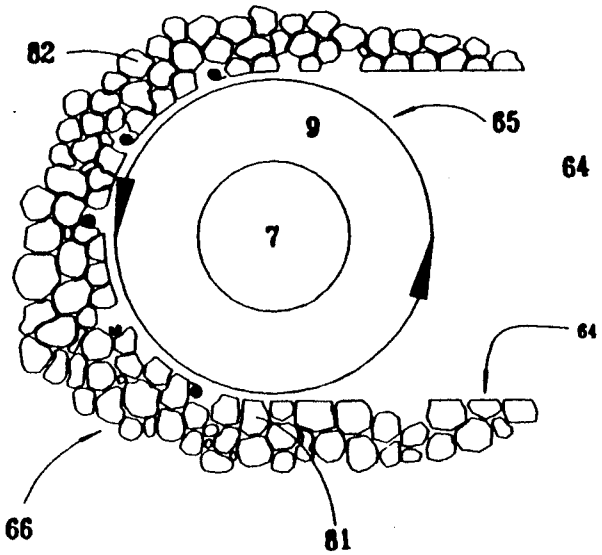
FIG. 6 which consists of FIGS. 6A and 6B are diagrammatic illustrations of the dynamic erosive effects of hydrodynamically induced intergranular and center-core cavitation of the type produced by the present invention.
Figure 6A:
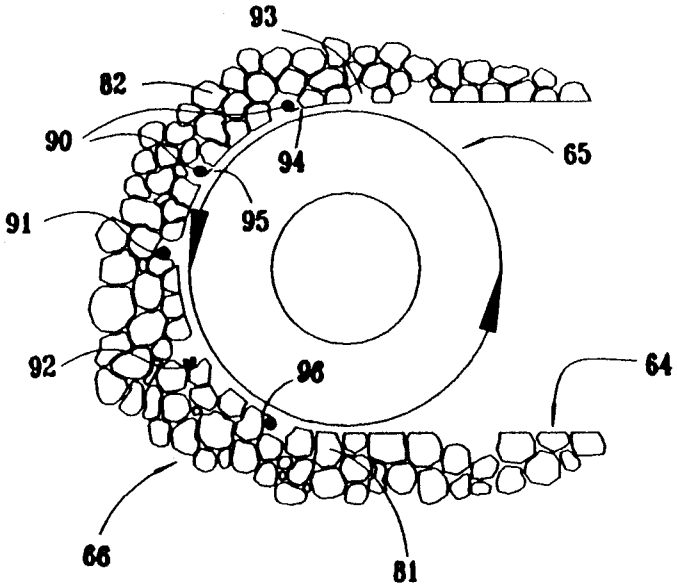

Referring now to FIG. 6, there is illustrated additional erosional mechanisms that would operate concurrently and in addition to the previously discussed pressure reversal-induced erosion. In FIG. 6A, there is illustrated a cross-section of the vortex jet stream 65 and the earthen formation 66 against which the vortex jet is being directed. The formation 66 is comprised of cemented grains 82. Representative grains 81 are shown on the boundary of the kerf wall 64 as it is cut by the vortex jet 65. The boundary layer of formation grains adjacent and generally forming a semicircle in front of the advancing vortex jet 65 are subjected to a pressure differential caused by a low pressure area in the boundary between the vortex jet 65 and kerf wall 64. As the vortex jet stream 65 is passed against the relatively uneven frontal surface voids 93 of the target formation, the formation 66 provides edged surfaces 94, 95 and 96 that promote hydrodynamic pressure reductions sufficient to produce cavitation in the fluid shear zone.

Cavitation, as used herein, refers to the formation and growth of vapor-filled cavities in a high velocity flowing stream of liquid where the local pressures surrounding the gas nuclei in the liquid are reduced below the pressure necessary for the nuclei to become unstable, grow and rapidly form relatively large vapor-filled cavities. This critical pressure is equal to, or less than, the vapor pressure of the liquid. When the local pressures surrounding the cavities rises sufficiently above the vapor pressure of the liquid, the cavities collapse and enormous pressure and potential destruction is created in the vicinity of this collapse. The effect on solids exposed to such collapsing cavities is called cavitational erosion.

The shear zone between the spinning vortex jet stream and the relatively stationary fluid in the pore spaces has been shown to create turbulent boundary layer incipient cavitation eddies and shedding vortices 90 which have low pressure regions in their centers that provide the conditions necessary for the development of cavitation. The cavitation bubbles 91 and 92 subsequently implode against the downstream formation surfaces attacking both the cementation and formation grains themselves. This phenomenon is discussed in part by S. C. Crow in his paper titled "The Effect of Porosity on Hydraulic Rock Cutting", International Journal of Rock Mechanics, Mining Science, and Geomechanics, Abstract Vol. 11, pp. 103-105.

Illustrated in FIG. 6B is the cross section of the spinning vortex jet 65 which has formed a low pressure vortex cavity 7 containing water vapor. This center core vapor cavity will collapse when the spinning stream velocity is reduced to a point where the stream pressures will no longer permit the presence of a center core cavity. This point of collapse can be termed the "cavitation stagnation" point of the center core vapor cavity. At this cavitation stagnation point, the center core materially collapses causing substantial instantaneous pressure and temperature increases of sufficient magnitude to locally disintegrate the formation. If the fluid pressure surrounding the jet issuing from the nozzle-cutter is denoted as Pa and the pressure in the supply to the nozzle-cutter as Pn, the jet stream exiting from any nozzle will cavitate at low values of the ratio Pa(Pn-Pa), which is defined in the cavitation number. If this pressure relationship is reduced substantially below the value at which cavitation occurs in wake vortices, a long trailing vapor filled cavity forms and sheds vapor cavities from its tail, as illustrated in FIG. 8B discussed below. These vapor cavities are convected with the circumferential and axial degrading vortex flow to a point where they collapse against the formation in response to ambient pressure.

Having described the theory of operation in conjunction with the illustration of FIGS. 3 through 6, reference will again be directed back to FIGS. 2A and 2B. These drawings illustrate one embodiment of a nozzle cutter assembly constructed in accordance with the principles of the present invention. FIG. 2B is a cross-sectional view of the housing 30, showing the sleeve 32 to be of a generally cylindrical construction. Other assembly configurations are clearly contemplated by the present invention, as the present structure is shown for illustration purposes only.

Figure 2C:
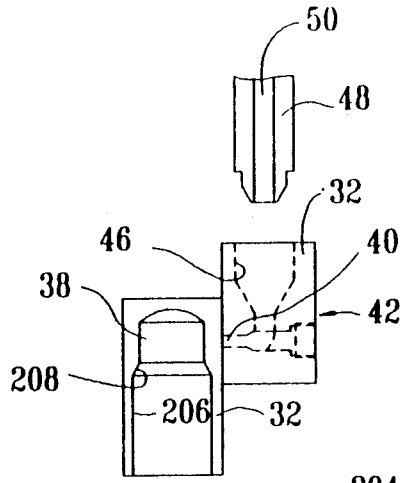

Referring now to FIG. 2C, there is shown an enlarged, diagrammatic, exploded, side elevational view of the assembly of nozzle 10. The nozzle cutter 15 is shown to be constructed of a generally bullet-shaped body portion 200 having an upper circumferential groove 202 formed therearound. Groove 202 is adapted for receiving an O-ring 204, or similar sealing member, therearound. Alternately the nozzle cutter 15 could be sealed with a metal to metal contact in this area. The upper, funnel-shaped feed taper 36 that is described in FIG. 2B above is shown as a part of the axial passage 18. The body 200 may be constructed of a wear resistant material such as tungsten carbide. The inside walls 206 of sleeve 32 are shown to be constructed with a tapered region 208 leading into upper cylindrical cavity 38. The sleeve 32 may be constructed of a wear resistant material such as stainless steel or titanium. Cylindrical cavity 46 is disposed adjacent block 42 and formed to receive feedline 48, having flow passage 50 formed therethrough.

Figure 2D:
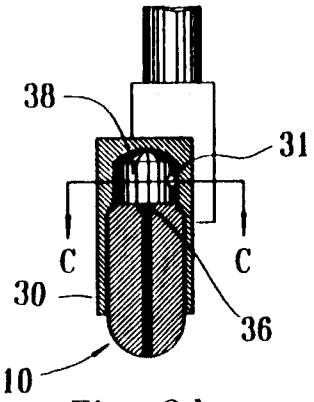
Figure 2E:
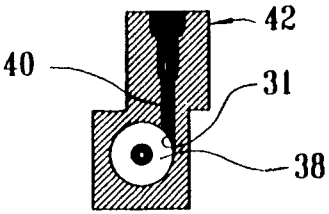

Referring now to FIG. 2D, there is shown an end elevational, cross-sectional view of the housing 30 of FIG. 2B taken along lines B—B thereof. In this particular view, the upper chamber 38 illustrates an elliptical opening 31 comprising the tangential entry of passage 40 (FIG. 2C) therein. From this tangential entry port fluid is injected for swirling flow. FIG. 2E further-illustrates this constructional feature. FIG. 2E comprises a top plan view of the housing 30 of FIG. 2D taken along lines C—C thereof. In this view, the passage 40 is shown in direct flow communication with chamber 38, forming elliptical orifice 31 therein.

Figure 2G:
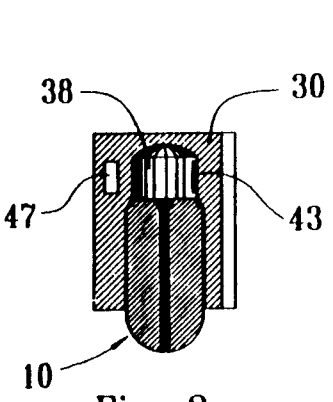
Figure 2F:
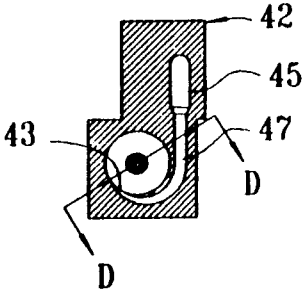

FIGS. 2F and 2G are alternative embodiments of the housing 30 of nozzle 10. In these views, a specific type of tangential injection, herein referred to as involuted injection, is provided by a rectangular passage 47. The involuted feed provides a transition from a circular feed plenum 45 to the converging, rectangular passage shown in FIG. 2F. This figure comprises an alternative embodiment of FIG. 2E; while FIG. 2G is a side elevational, cross-sectional view of the nozzle and housing taken along lines D—D of FIG. 2F.

Still referring to FIGS. 2F and 2G, the structure therein affords numerous benefits relative to the flow characteristics of a the swirling, tangential system. The advantages of introducing a rectangular slot type feed into the vortex generator include the greater relative volume that can be fed into the generator without sacrificing angular velocity. The thinner cross section of a rectangular feed configuration, for the same relative volume as a circular feed configuration, will tend to increase the number of stream lines that the fluid will travel through prior to exiting the generator. This desirably increases the centrifugal force. From a structural standpoint, the housing 42 may be cast as described above and the feed into housing 42 can be the same as illustrated in FIG. 2D above. As the flow enters passage 45 it moves from the circular passage into the rectangular configuration of passage 47. The flow which is moving towards the generator enters a converging section and ultimately enters the vortex generator at rectangular entry port 43, affording the multiple stream lines that the fluid will travel through prior to exiting the nozzle 10. As stated above, the term involuted injection is herein utilized as a specific type of tangential injection that may be utilized in certain applications.

Figure 7D:
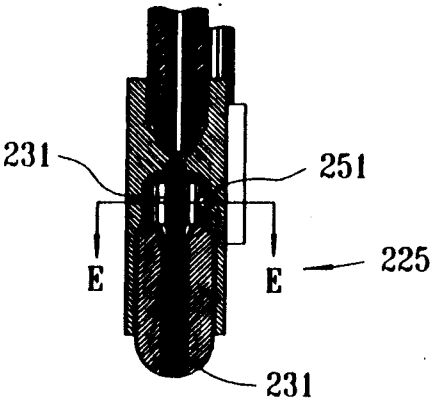
FIG. 7 which consists of FIGS. 7A through 7E are views of an alternative embodiment of a vortex jet configuration adapted for utilizing a separate abrasive particle fluid stream to increase the effective erosive power thereof.
Figure 7E:
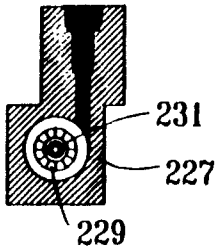
Figure 7A:
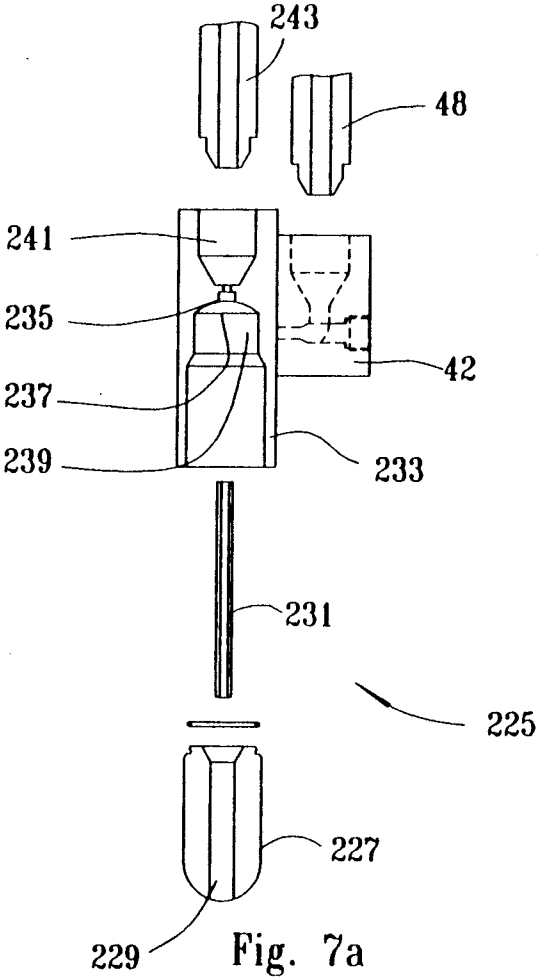

Referring now to FIGS. 7A-7E, there is shown an alternative embodiment of the nozzle 10 of FIG. 2A-2E. FIG. 7A is an exploded, diagrammatical, cross-sectional view of a nozzle 225. The elongate nozzle cutter 227 has an enlarged orifice 229 to permit the receipt of a tubular feed member 231. The construction of cutter 227 is substantially identical to the construction of bullet-shaped member 200 of FIG. 2C in other respects. The tubular member is adapted for being received within sleeve 233 for the introduction of abrasive particles of the type described above. The sleeve 233 is thus constructed with an upper feed passage 235, formed in the upper end 237 of swirl cavity 239. A tapered port 241 is constructed in flow communication with passage 235 and adapted for matingly receiving (or otherwise engaging) a feed line 243. The feed line 243 may be formed of seamless, austenitic stainless steel tubing, and is adapted for the flow of abrasive particles to flow passage 235 and tubular member 231 in a manner to be described below. In this assembly, the remaining feed sections are substantially identical, including feed line 48 and the adjacent, rectangular feedblock 42.

Figure 7B:
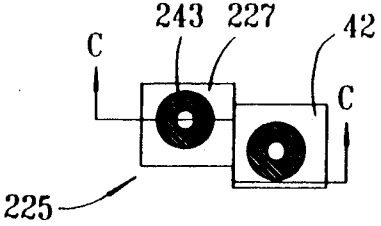
Figure 7C:
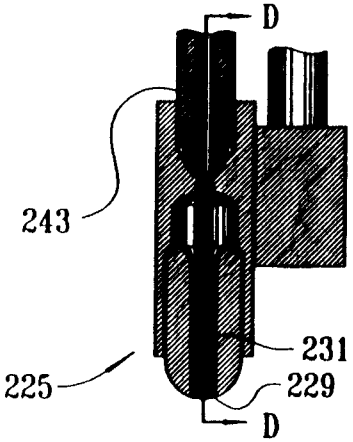

Referring now to FIG. 7B, there is shown a top plan view of the nozzle 225. Feedblock 42 is shown disposed adjacent modified housing 227 with abrasive feed line 243 upstanding therefrom. From this view, FIG. 7C is seen as a side elevational, cross-sectional view of the nozzle 225 of FIG. 7B, taken along lines C—C thereof. The tubular member 231 is shown to be disposed within aperture 229 and in direct flow communication with feed line 243. In this manner, abrasive material may be discharged directly into the vortextural effluent without causing significant disruption or excessive internal wear thereto. Referring now to FIG. 7D, there is shown a side elevational, cross-sectional view of the assembly 225 taken along lines D—D of FIG. 7C. The elliptical formation of tangential orifice 251 may be seen for the flow of liquid therein and around feed tube 231. In this position, the feed tube 231 still permits the egress of the swirling , vortex from the cutter nose. FI G. 7E further illustrates this tubular relationship. FIG. 7E is a top plan cross-sectional view of the nozzle 225 of FIG. 7D taken along lines E—E thereof. In this view, the tangential entry and the position of the tubular member 231 is shown axially disposed within the central aperture 229 of housing 227.

Figure 8A:
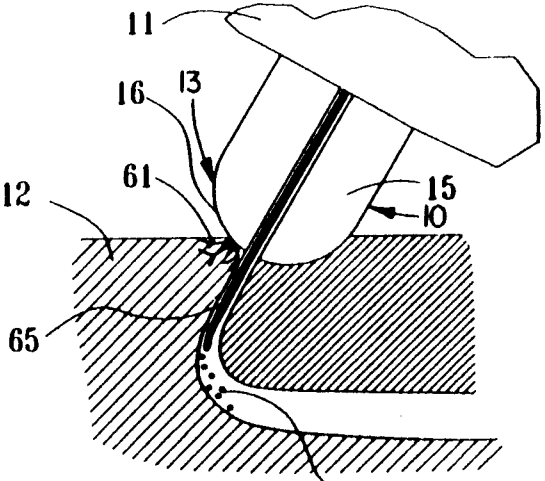
FIG. 8 which consists of FIGS. 8A and 8B are side elevational, cross-sectional views of the vortex jet tool of FIG. 1 illustrating further aspects of the operation thereof, and for which cross-sectional views are taken about lines A—A, B—B, C—C, and D—D of FIG. 8B and illustrated in FIGS. 8C, 8D, 8E and 8F respectively as FIGS. AA, BB, CC and DD.

Referring now to FIG. 8A, there is shown the operation of nozzle 10 in engagement with the formation 12. As is true with any fluid jet, the energy of the jet will degrade exponentially with increased distance from its nozzle exit. The present invention thus provides a method of constructing the exhaust tube of the vortex jet 10 as hard mechanical cutter 15. This structure allows the placement of the distal end of the nozzle cutter and the spinning liquid vortex jet immediately adjacent to the target formation 12 to take advantage of the highest Jet energy levels possible. The use of a mechanical cutter as the discharge nozzle 10 provides the basis for employing the maximum hydrodynamic energy effects immediately adjacent to, and in combination with, the stress and/or fracture propagation action 61 of the mechanical cutter. This combination, and its variants, of the jet erosion mechanisms coupled with the cutter/nozzle mechanical cutting mechanisms, effectively merges additional hydraulic erosion and mechanical cutting mechanisms to produce a significant increase in cutting ability.

Referring still to FIG. 8A, there is illustrated the vortex jet and cutter combination in reference to the fracturing and erosion of the formation 12. As the housing 11, supporting the nozzle 10, is rotated about its axis, the protruding nozzle cutter 15 is forced against and into the formation 12, synergistically merging the mechanically induced formation stresses, developed by the cutter gouging, fracturing and shearing, with the crack propagating hydraulic energy of the high speed vortex jet stream. The use of a hard material such as tungsten carbide to form the nozzle cutter 15 or a hard surface material, such as polycrystalline diamond or cubic boron nitride, on the nose 13 will provide erosion protection for the nozzle from the mechanical abrasion erosion of the formation 12 as it is engaged by the nozzle cutter 15 while additionally providing protection from jet derived splash back erosion normally associated with high speed jet actions. As the jet is forced onto or into the formation by the mechanical action of the particular cutting tool comprising housing 11, the relatively large diameter of the nozzle cutter 15 provides a splash back deflection shield that deflects the splash back action of the vortex jet stream away from the critical components that retain the nozzle cutter in place in housing 11. This is a significant improvement as prior art jetting apparatus must provide for this type of protection over a much larger, area due to the stand-off required for their nozzles, which makes the nozzles and nozzle carriers susceptible to the significant, problem of direct splash back erosions effects.

Referring now to FIGS. 1 and 8A in combination, the nozzle cutter 15 has been illustrated as a hemispherically shaped nozzle cutter. However, most shapes provided for cutting tools to effectively cut may suffice in this region. As shown in FIGS. 1 and 8A, the hemispherically shaped nozzle cutter face 16 in this embodiment is ideal for the inter-kerf wedging effects it would produce while constantly shifting the face of the nozzle cutter point of contact with the formation due to the infinitely changing rake angles of the hemispherical shape. This produces the effect of moving the formation materials away from the center of the nozzle cutter in all planes. The hemispherical shaped nozzle cutter face 16 provides formation fracturing between the kerfs 24 and 26 by exerting downward and lateral forces on the lands 17 and 19 in the forward and lateral planes. The hemispherically curved distal surface of the nozzle cutter 15 provides maximum formation fracturing, gouging, work hardening and shearing assistance for the jet action while exhibiting requisite cooling efficiencies. The nozzle cutter 15 further provides significant thermal stress reduction normally associated with mechanical cutters. This cooling is accomplished through internal cooling as the vortex jet flows through the nozzle cutter center flow path drawing heat from the nozzle cutter 15 and housing 11 as well as the exterior cooling derived from the immediate proximity of the jet which will provide forced exterior cooling of the nose 13. This significant reduction in thermal stress degradation will allow higher relative weights and/or higher RPM to be carried by nozzles 10.

Figure 8F:
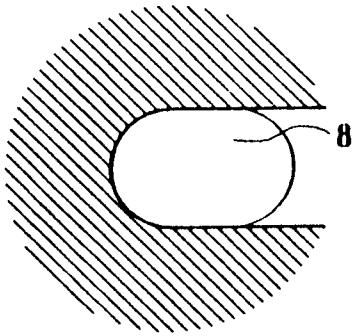
Figure 8E:
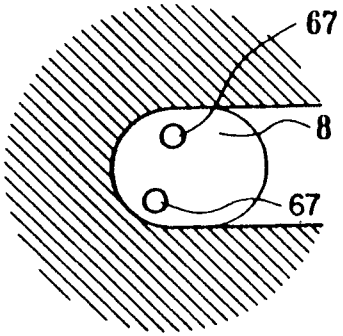
Figure 8B:
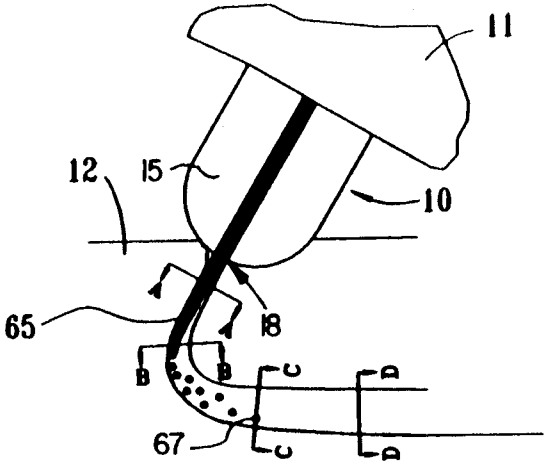
Figure 8D:
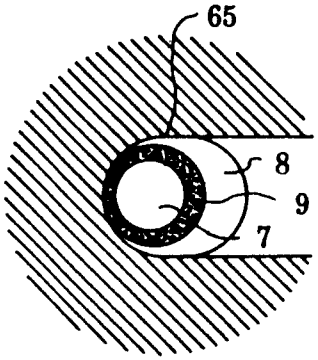
Figure 8C:
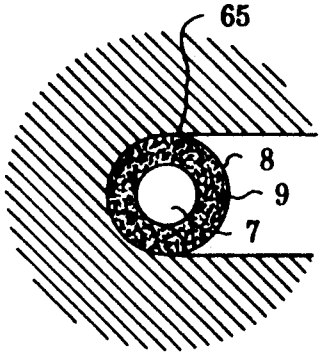

Referring now to FIG. 8B, there is shown a sectioned elevation view of the vortex jet phase changes at various stages of its degradation as indicated by sections AA, BB, CC and DD shown in FIGS. 8C, 8D, 8E, and 8F respectively. Referring now to FIGS. 8B and 8C, there is shown in FIG. 8C cross-section AA from FIG. 8B which illustrates the vortex jet 65 shortly after exiting the nozzle cutter 15. At this distance the jet is still fully formed with the same relative cross-sectional area as-is developed in the discharge aperture 18. It is in this region that the combination of hydraulic fracture propagation, pressure reversal erosion, abrasive erosion and in situ intergranular cavitation are acting at their maximum values. It can be clearly seen that the vortex jet 65, due to its rotational motion, provides a relatively longer duration of the hydraulic/abrasive erosive forces at a given distance from the nozzle cutter exit than would be exhibited with an axial jet.

Referring now to FIGS. 8B and 8D, there is shown in FIG. 8D cross-section BB from FIG. 8B which illustrates the vortex jet 65 approximately 5 to 10 nozzle diameters after exiting the nozzle cutter. At this distance the jet 65 is still formed, although deforming in shape. This region exhibits the combination of hydraulic fracture propagation, pressure reversal erosion, abrasive erosion and in situ intergranular cavitation. These forces are acting in this region at somewhat lesser values. The center core cavity is also shown to be collapsing in response to degradation of the flow region 9 which begins to expose the core region to the ambient pressures. It is in this region that the cavitational erosion may be at its highest values due to the relatively large volume of collapsing core.

Referring now to FIGS. 8B and 8F, there is shown in FIG. 8F cross-section DD from FIG. 8B which illustrates flow region 8 that exhibits only large helical motion and expends the residual energy in cuttings scavenging and sweeping the fractured lands to the adjacent cutting tool junk slots for removal. In this fashion, the vortex jet nozzles 10 are used in generating slots and fracturing of the lands between the slots to complement the action of the mechanical cutters. Referring now to 8B and 8E, there is shown in FIG. 8E cross-section EE of FIG. 8B which illustrates a transition point between cross-sections BB and DD of FIG. 8B. Referring now to FIGS. 8B–8F, between cross-sections BB and CC the pressure relationship is adjusted to the point where the long trailing vapor filled cavity forms and sheds vapor cavities 67 from its tail 65. These vapor cavities 67 are convected with the circumferential and axial degrading vortex flow to a point where they collapse against the formation in response to ambient pressure as illustrated in cross-sections CC and DD.

The present invention, as shown in FIG. 1 through FIG. 8F thus provides a new and improved cutting system for inclusion in cutting tools, such as drill bits. The system is adaptable for use in deep-hole drilling of the type that utilizes the advantageous destructive forces of mechanical/hydraulic fracturing and erosion in combination with conventional mechanical drill bits such as natural diamond or polycrystalline compact or roller cone bits. The nozzles of the present invention can be used in drill bits that employ diamond impregnated matrix cutting lands, surface set diamond cutting lands and exposed polycrystalline diamond compact cutters mounted on the drill bit lands. The nozzles of the present invention can be used with roller cone drill bits by placing them in extend lands between the roller cones. Such a combination achieves a significant advantage not only in terms of an increase in destructive power, but a decrease in energy requirements over high pressure liquid jet assisted drill bits that operate under impact erosion.

Figure 9A:
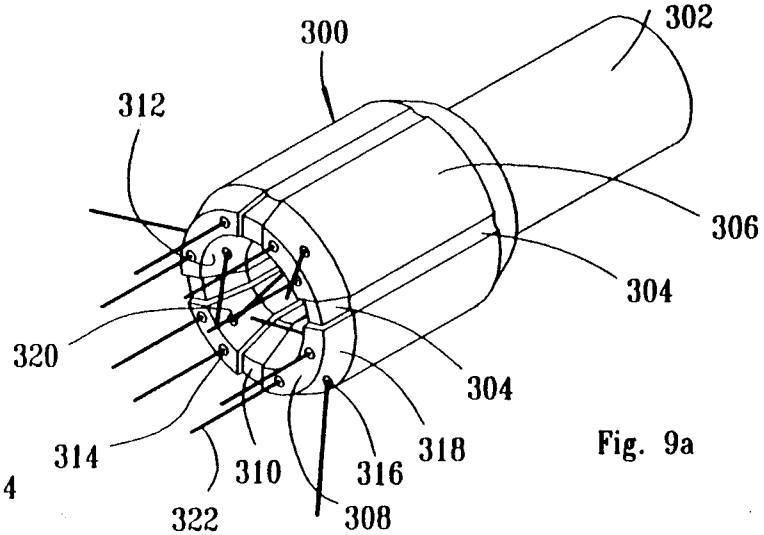
FIG. 9 which consists of FIGS. 9A–9C are views of one embodiment of the vortex jet of the present invention used in conjunction with a drill bit exemplary of various types of formation and rock-cutting tools.
Figure 9C:
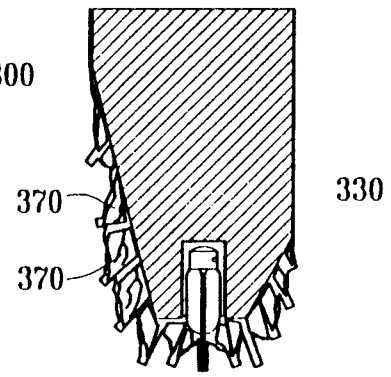
Figure 9B:
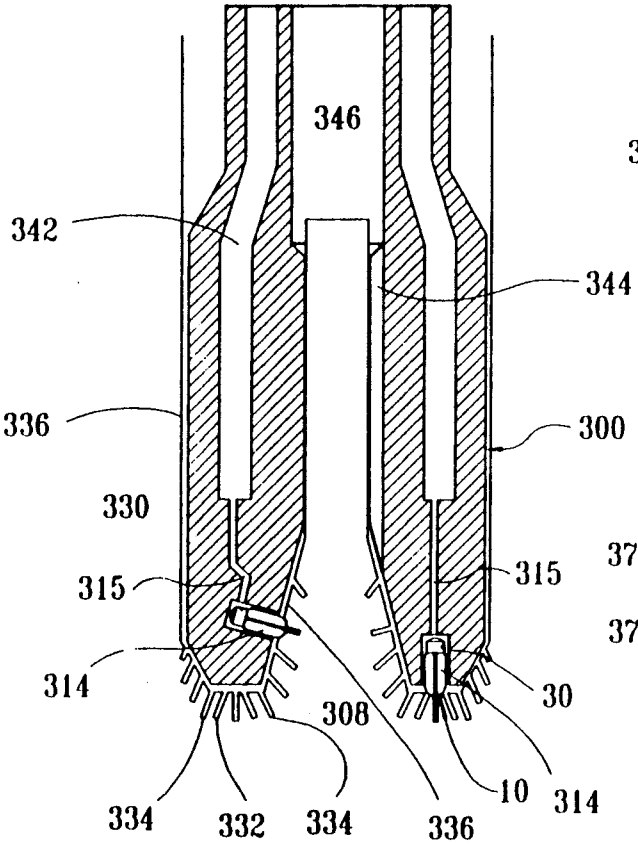

Referring now to FIGS. 9A–9C, there is shown one particular embodiment of a tool constructed in accordance with the principles of the present invention and utilizing the jet nozzle described above. As also discussed above, the jet nozzle 10 may be utilized in both bore hole drilling as well as mining applications. The present discussion pertains to the single, exemplary application of a well bore core drilling tool for which this particular jet orifice may be particularly adapted. FIG. 9A comprises a perspective view of one embodiment of a drill bit 300 adapted for use in accordance with the principles of the present invention. The drill bit 300 may be secured to the end of a dual-concentric drill string 302, of the type set forth and described in copending patent application Ser. No. 516,125 and owned by the applicant of the present invention. The drill bit 300 as shown herein comprises a cylindrical body 306 having a plurality of slots 304 formed along the cylindrical side walls thereof. The slots 304 are of the type commonly referred to as "junk slots" in the industry. The junk slots 304 extend across the distal end, or face 308 of the drill bit 300 to form recessed regions 310. The junk slots 304 then extend into the mouth 312 and the throat of the drill bit 300 as shown in the drawings. A plurality of fluid discharge ports or orifices 314 may be seen to be disposed about the body, face and mouth of the drill bit 300. A fluid discharge port 316 is, for example, disposed outwardly along taper, or chamfer area 318. Chamfer area 318 comprises a transition region between the generally cylindrical body 306 and the face 308 of the drill bit 300. Likewise, fluid discharge ports 320 are disposed in the mouth 312 at select positions and orientations as hereinafter described. The discharge of the high speed, vortexially swirling fluid,, in accordance with the principles of the present invention, is illustrated through the lines 322 emanating from each fluid port 314. The fluid discharge is specifically adapted for cutting the subterranean formation as described above and is further illustrated below.

Referring now to FIG. 9B, there is shown an enlarged, side elevational, cross-sectional view of the drill bit 300 and a subterranean formation 330. The formation 330 is depicted with a diagrammatical kerf pattern 332 which illustrates one pattern of cutting produced by the fluid jets 314 of FIG. 9A. A plurality of kerfs 334 are thus seen extending into the formation 330 adjacent a surface 336 comprising the outline of the subterranean formation 330 adjacent the drill bit 300. In actual use the flow of fluids in the grinding, breaking and crunching action of the drill bit would produce a variety of earthen configurations. What is shown herein is the drill bit 300 in a diagrammatical illustration of the effect of the discharge jets 314 and the cutting action produced thereby. The internal flow passages 315 to the jets 314 are shown diagrammatically only. The internal flow passages 315 would be either manufactured ports cast into the bit as is normal for one piece bits or alternately could be constructed of high pressure lines built into or installed in the bit. It should also be noted that passages 315 are coupled to the high pressure flow area 342 coupled to the drill pipe 302 as discussed above in FIG. 9A. A central bore 344 disposed centrally within face 308 is adapted for the flow of subterranean formation cuttings and drilling fluids upwardly therethrough and is provided in flow communication with a central flow passageway 346 in flow communication with the drill pipe 302 (FIG. 9A) coupled thereto.

Referring now to FIG. 9C, there is shown an enlarged side elevational, fragmentary cross-sectional view of the bit of FIG. 9B illustrating the result of mechanical movement therewith. Referring now to FIG. 9A through 9C in combination, as in above-referenced, co-pending patent application, the drill bit 300 is rotated in conjunction with the discharge of fluid through jet orifices 314. The junk slots engage the surface 336 and impart mechanical forces to the subterranean formation around kerfs 334. The kerfs 334 weaken this region of the formation resulting in fractures. The sections 370 of the formation 330 are thus shown to be fractured and broken as will result by the rotation of the bit 300 as said bit engages the weakened section 370 in which kerfs 334 are selectively formed. As weakened sections are disposed between the rotating junk slots 304, they are broken off into chunks 370. The chunks 370 then migrate under the pressure of the fluids discharged from the jets 314 upwardly into bore 344 and subsequently into conduit 346 for flow upwardly within the dual-concentric drill pipe described in the above-referenced patent application incorporated herein by reference.

Figures 10A, 10B, 10C, 10D:
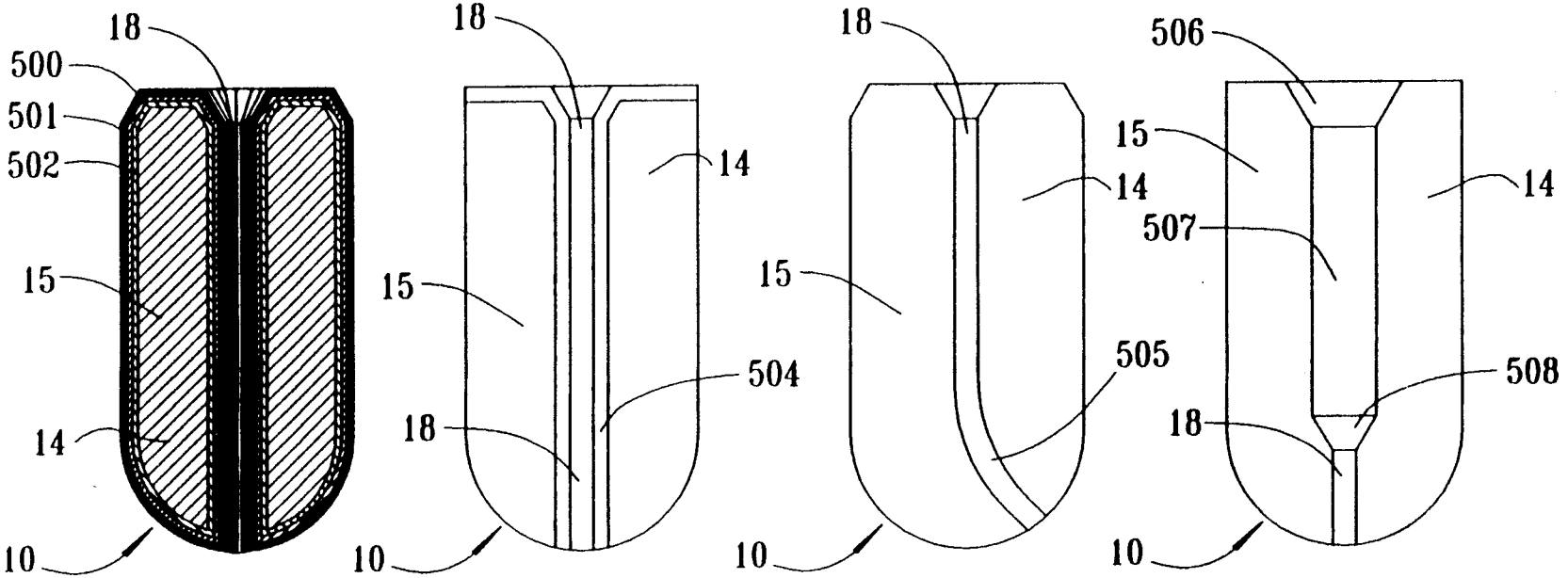
FIG. 10 which consists of FIGS. 10A–10D illustrate cross-sectional views of four different configurations of vortex jet tool nozzles which provide different operational results.

Referring now to FIG. 10A–10D, there is shown a series of cutters 15 in side elevational, cross-sectional views. Various configurations of the cutter 15 can be utilized for the specialized use according to the principles of the present invention. FIG. 10A illustrates a side elevational, cross-sectional view of a jet cutter 15 of a wear nozzle 10 having applied thereto successive substrata coatings 502, 501 and exterior coating 500. The coatings may be comprised of polycrystalline material of varying degrees of hardness and elasticity to provide adequate transition from the more elastic tungsten carbide core material to the hardest outside layer adapted to engage the surface to be cut. The coating is seen to be applied evenly about the generally cylindrical body 14 of the jet cutter 15 in a multiple layer configuration that will afford superior wear capabilities. The polycrystallized diamond (PCD) exterior presents a surface hardness that is capable of withstanding wear in the hostile environment of the wear nozzle 10. Superior wear characteristics in both the external surfaces as well as the internal aperture 18 should result in great reliability as well as effectiveness. It should be noted that the jet discharge occurs through aperture 18 and thus the rationale for the coating as illustrated herein.

Referring now to FIG. 10B, there is shown a wear nozzle 10 wherein the top and central portions of aperture 18 are covered with a liner 504. The liner 504 can be comprised of a more elastic type material such as a hardened steel or titanium material. The binder material, such as a copper alloy, used to bind the tungsten carbide nozzle matrix 14 may unduly expand under extreme internal pressure. By placing a hardened steel or titanium liner within the nozzle, the more dense steel will act as a pressure liner and thus when backed by the tungsten carbide will form an impregnable but elastic plenum for the high speed jet. As shown in this embodiment, elasticity is provided within the aperture to absorb internal pressures caused by expansion within the body 14 of the jet cutter 15. In this manner, the more elastic steel liner 504 will provide a flexibility for the movement caused in the tungsten carbide due to the more elastic binder material.

Referring now to FIG. 10C, there is shown a jet cutter 15 constructed of tungsten carbide having a cylindrical body 14 constructed of tungsten carbide wherein the aperture 18 is formed in a curved configuration allowing the discharge of fluid from an off center position. An aperture section 505 is curved to allow directional discharge from the wear nozzle 10 which may be required in select applications. For example, placement of the nozzles in a cutting tool may be restricted due to select design criteria and it may be necessary to have the nozzle discharge at an angle that is not axially aligned with the jet cutter 15 of the wear nozzle 10, specifically important in areas such as the edge of a drill bit where it is undesirable to have the wear button extend beyond the gauge requirements of the drill bit. In this manner, discharge of the jet will be directed in a manner that is optimized for the particular application.

Referring now to FIG. 10D, there is shown jet cutter 15 of wear nozzle 10 formed with a modification to the discharge aperture 1 B. Aperture 18 thus includes enlarged conical conversion tubes 506 and 508 providing conversion into aperture 18. This embodiment would permit the swirling discharge of liquid to maintain a slower rate of rotation throughout the length of the cylindrical body 14 wherein the length of the discharge of the liquid through the narrow aperture 18 would be substantially reduced to maximize efficiency and reduce frictional forces upon the liquid swirl. Consistent therewith, various configurations of the aperture 18 may be provided in accordance with the principles of the present invention. As shown below, aperture 18 can include a myriad of sizes and shapes specifically adapted for the maximum transfer of a swirling liquid mass for discharge from the end of jet cutter 15 as shown herein.

Figures 11A, 11B, 11C:
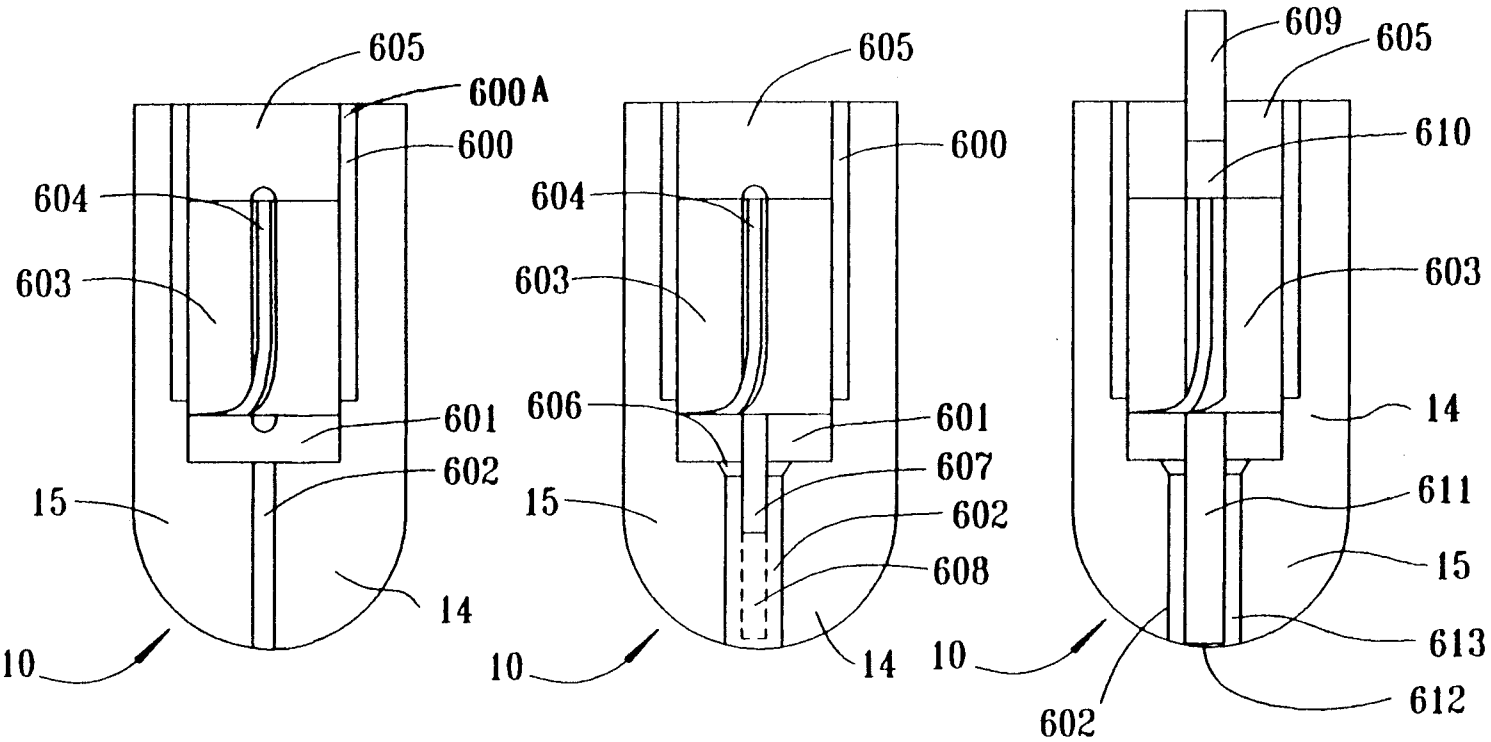
FIG. 11 which consists of FIGS. 11A–11C illustrate cross-sectional views of alternative embodiments of the vortex jet tool nozzle utilizing an in-line vortex generator.

Referring now to FIGS. 11A–11C, there is shown various embodiments of an in-line swirl initiator unit. FI G. 11A illustrates the cylindrical body 14 of jet cutter 15 constructed with enlarged aperture 605 having inserted therein an axial stator 603. Stator 603 is comprised of four or more flow veins 604 which, in part, due to their contoured shape, impart a swirling motion to the fluid being passed therethrough. This swirling fluid passes into swirl chambers 601 and ultimately discharged as a vortex flow into the narrow aperture 602. In one embodiment, the stator 603 may be secured in position by keys 600A inserted in groove 600. This embodiment illustrates one method of generating a swirling flow within a jet cutter 15 without tangential injection.

Referring now to FIG. 11B, there is shown a jet cutter 15 of a wear nozzle 10 having a generally cylindrical body 14 constructed of tungsten carbide or the like wherein stator 603 is mounted with vein 604 to impart a swirling motion to the fluid being passed therethrough. In this particular figure, an extended post 607 is inserted axially within the assembly extending from the central part of the stator 603 into aperture 602. The axial position of the center post 607 can be extended between the position shown in 607 and the phantom lines of 608. The purpose of the post 607 is to provide center jet cavitation development and therefore could vary from position 607 to 608 depending upon the mode the operator requires in order to mature the cavitation collapse contiguous the formation. It is important to note that the prior art systems have utilized a center post to create center jet cavitation. Such assemblies have been difficult to manufacture because their use with an axial flow jet requires stabilization that interferes with the flow therearound. In the present embodiment the swirl imparted to the flow by the stator 603 facilitates stabilization of center post during its discharge therearound. As the vortex flow rotates around the center post and moves axially it stabilizes the center post thus allowing it to function effectively and reliably over a greater range of operating conditions.

Referring now to FIG. 11C, there is shown the jet cutter 15 of the wear nozzle 10, also made of tungsten carbide or the like. In this embodiment a stator 603 is inserted into cylindrical area 605 of body 14 with a substantially enlarged discharge aperture 602. Aperture 602 is enlarged in order to receive tubular member 611 adapted for carrying an abrasive stream and injecting said abrasive stream into the center part of the swirling jet discharged from aperture 602 and around tubular member 611 as described above.

Figure 12:
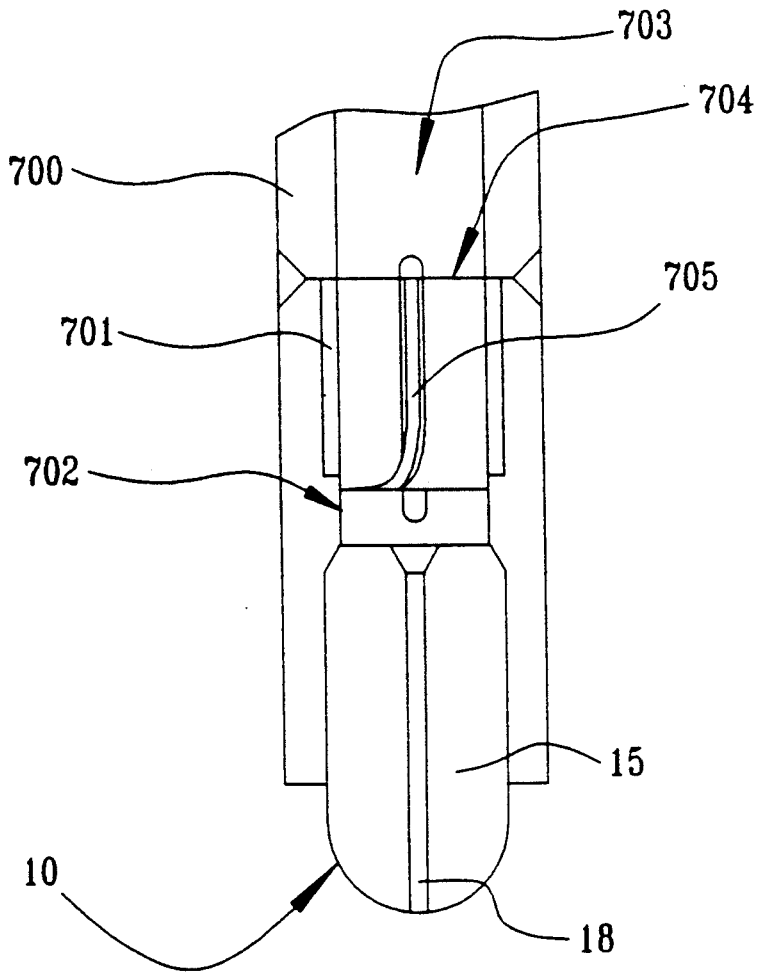
FIG. 12 illustrates a cross-sectional view of the vortex jet tool utilizing an upstream in-line vortex generator in the supply line.

Referring now to FIG. 12, there is shown yet another embodiment of means for generating a vortexural swirl of liquid in accordance with the principles of the present invention. Jet cutter 15 of wear nozzle 10 is disposed axially beneath a swirl generator stationed thereabove. A supply tube 700 houses the stator 704 positioned above the jet cutter 15 which creates a swirl chamber 702 thereabove. As fluid flows through supply tube 700 across the stator vein 705 it imparts a swirling motion to the fluid, then the swirl chamber 702 creating the vortex which is then exited into the aperture 18 of wear nozzle 10 for discharge therefrom.

Figure 13A:
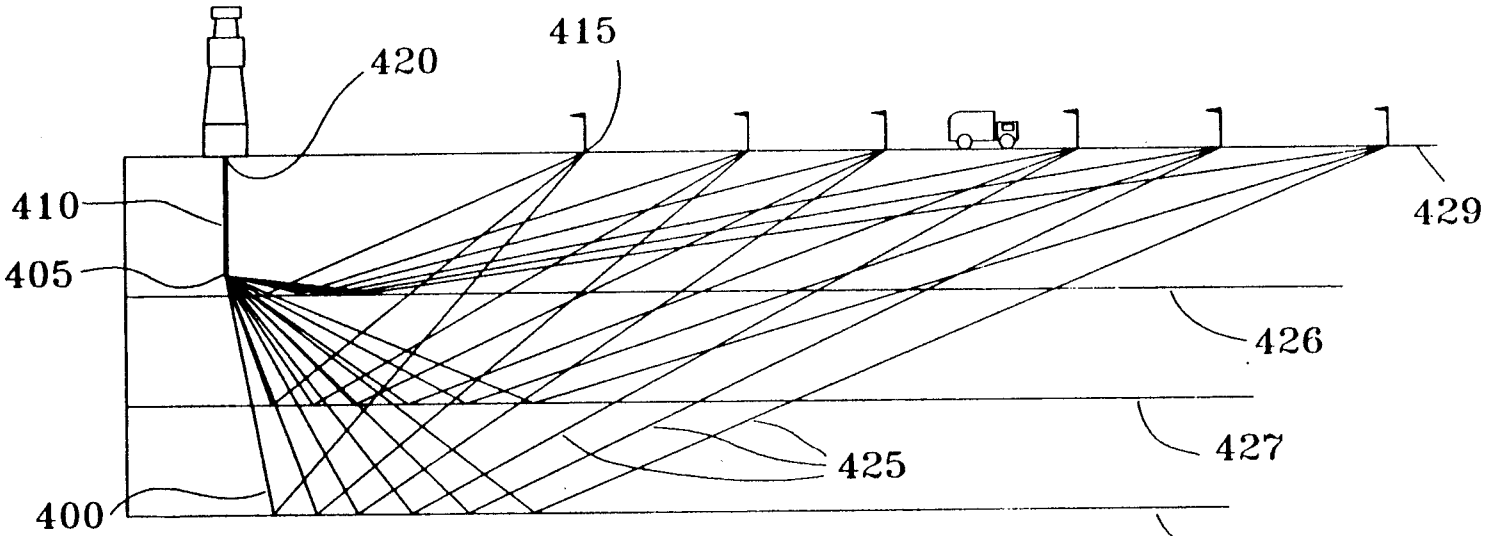
FIG. 13A and 13B illustrate the use of a vortex jet as a sound source for seismic-while-drilling operations.
Figure 13B:
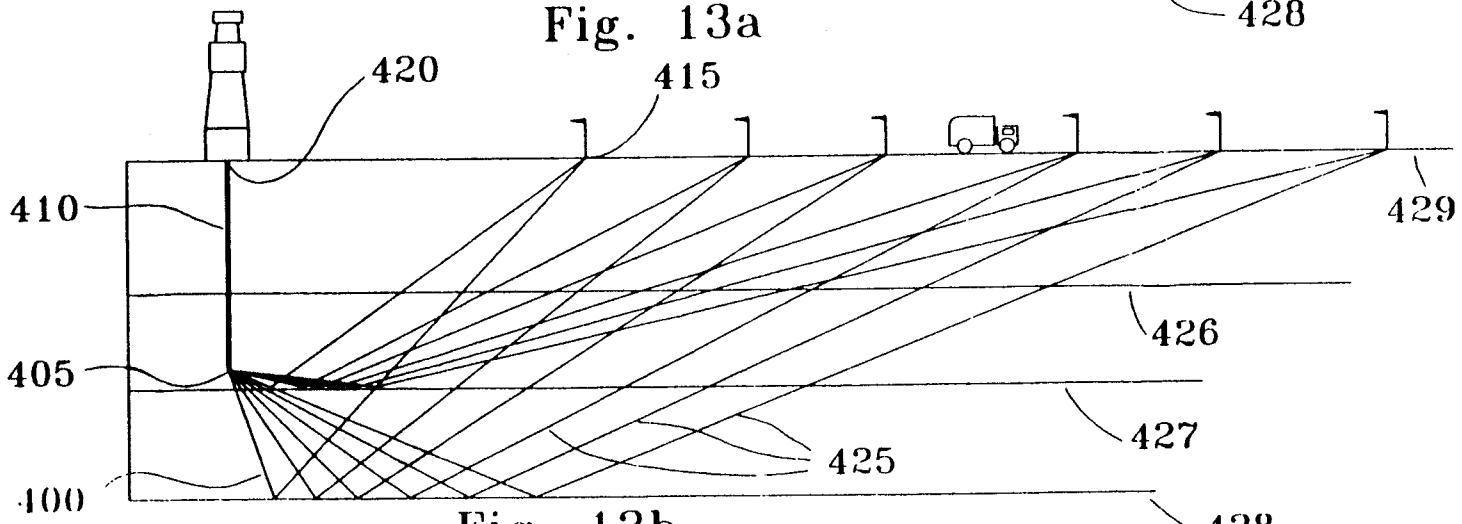

Referring now to FIGS. 13A and 13B, there is shown a diagrammatic cross section of a drilling system 420 creating a well bore 410 with a drill bit in the area 405. The drill bit is constructed in accordance with the principles of the present invention to produce a jetting action. The jetting , action generates a tone comprising vibrational signals 400 that reflect off of horizons 426, 427 and 428, each being respectively deeper in depth than the drill bit 405. The above referenced vibration, or sound waves, are then reflected off the horizons back to the surface 429 where the signals 425 may be detected by sensors such as phones 415 with the data logged therefrom. In FIG. 13B the same cross-sectional elevation is illustrated with the drill bit having progressed deeper into the well bore 410 past horizon 426 and above horizon 427. At this point the drill bit is generating signals 400 which are bounced off only horizons 427 and 428 back to surface 429. The signals 425 are picked up by geophones and recorded as data.

Figure 14:
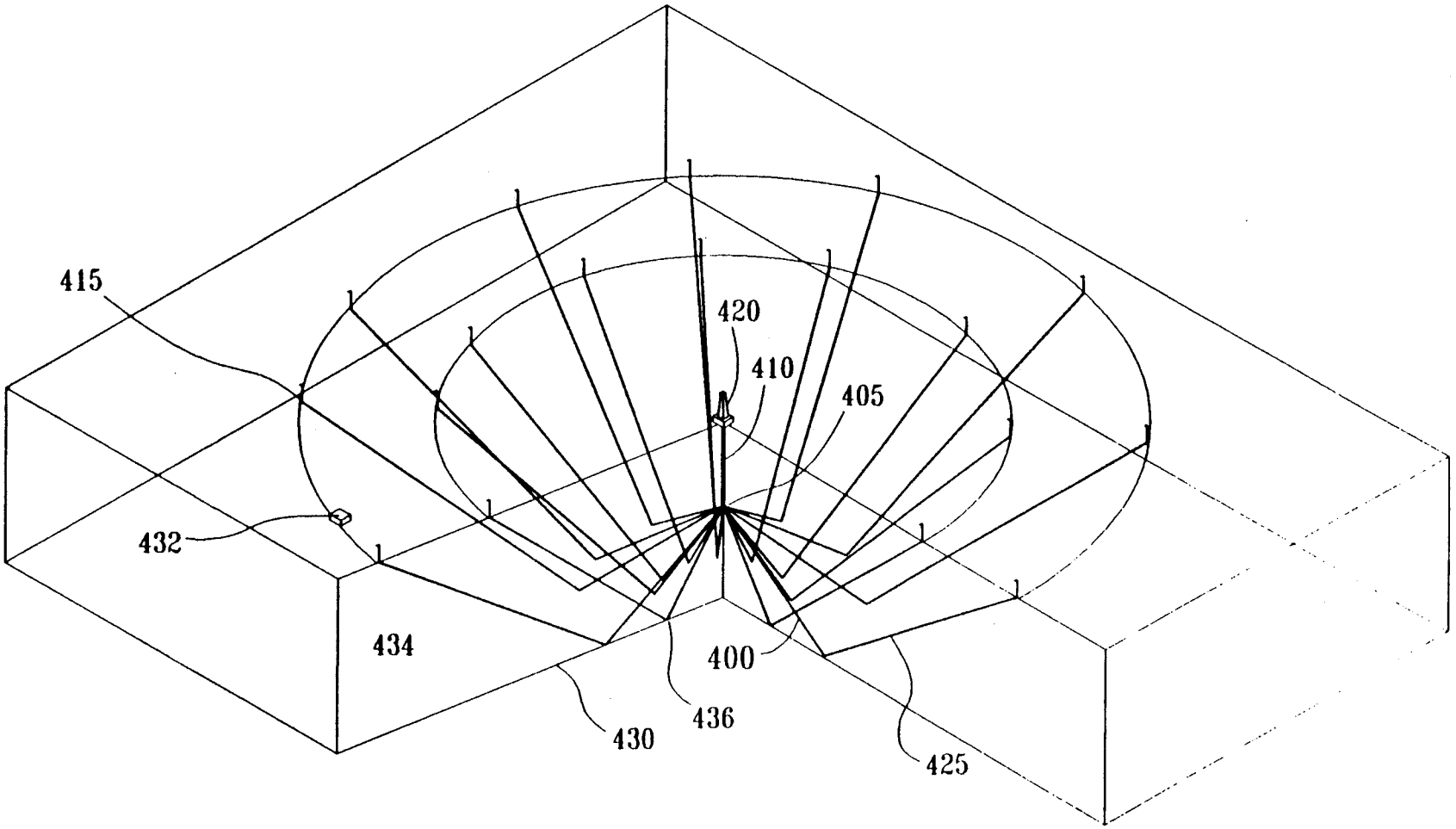
FIG. 14 illustrates the use of the vortex jet as a sound source for seismic-while-drilling using an arrayed seismic pickup system.

Referring now to FIG. 14, there is shown a diagrammatic perspective view of the drilling unit 420 generating a well bore 410 with the drill bit 405 positioned within the well bore. The drill bit 405 generates a tone comprised of vibrational signals 400 which bounce off horizon 430 back to the surface. The signals 425 are picked up by geophones 415 and collected as data at recording station 432. This particular view shows an array of phones that can be set about a drilling operation that will provide for a three-dimensional perspective interpretation of subsurface geological data based upon the signals generated and interpreted as seismic signals during the drilling operation. It is important to note that these signals are generated during the drilling operation to model the formation ahead of the drill bit 405. This promotes safety through detecting horizons that are geopressured. The system also allows stratigraphic and structural definitions on a three-dimensional perspective from the well bore itself providing significantly enhanced structural and well bore correlation.

Although specific reference has been made throughout FIGS. 1 through 12 to a rotational drilling tool incorporating nozzles 10, it should be noted that said nozzles could be used in a variety of other tools. These tools could include mining tools and those tools for which no rotational motion is afforded. It is thus believed that the operation and constructed of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved cutting tool for the erosion of a surface, said tool being of a type wherein a liquid jet is discharged from said tool to create an eroded region, said improvement comprising:

a tool body having a plurality of discharge nozzles disposed thereabout;

said discharge nozzles extending outwardly from said tool body for engagement with said surface;

a generally cylindrical chamber disposed in flow communication with said nozzles;

means for creating a liquid swirl within said chamber; and means for discharging said liquid swirl from said chamber and through said nozzles in a vortex jet stream against said surface for the erosion thereof.

2. The apparatus as set forth in claim 1 wherein said discharge nozzles include a cutting member having an aperture formed therethrough, said aperture being disposed in axial flow communication with said chamber for receiving said liquid swirl therefrom, and said nozzle being constructed for mechanically engaging the formation for imparting mechanical stress thereto.

3. The apparatus as set forth in claim 1 wherein said liquid swirl creation means comprises means for injecting high pressure liquid tangentially into said cylindrical chamber.

4. The apparatus as set forth in claim 1 wherein said liquid swirl creation means comprises a stator disposed within said chamber for the generation of a liquid swirl therein.

5. The apparatus as set forth in claim 1 wherein said liquid swirl creation means comprises means for involuted injection of liquid into said cylindrical chamber.

6. The apparatus as set forth in claim 1 wherein said discharge nozzles are each formed with an hemispherical nose adapted for mechanically abutting said surface and said tool further includes mechanical cutters disposed in association with said nozzles for cutting said surface.

7. The apparatus as set forth in claim 1 and further including means for injecting an abrasive stream into said swirl liquid jet.

8. The apparatus as set forth in claim 7 wherein said abrasive stream is gaseous.

9. The apparatus as set forth in claim 7 wherein said abrasive stream is liquid.

10. The apparatus as set forth in claim 7 wherein said injection means includes a tubular member axially disposed within said cylindrical chamber adapted for the flow of said abrasive stream therethrough, said tubular member being disposed within said nozzle for the discharge of said abrasive stream therefrom in conjunction with said swirling liquid jet.

11. Apparatus for eroding a solid surface with a swirling liquid jet comprising:

a housing adapted for movement relative to said surface;

means associated with said housing for forming a swirling liquid jet discharging a vortex jet stream;

at least one liquid jet nozzle secured to said housing and positioned in flow communication with said jet means for the discharge of said swirling liquid jet therefrom; and means for moving said housing relative to said surface.

12. The apparatus as set forth in claim 11 wherein said jet means include a generally cylindrical chamber disposed within said housing and a liquid flow passage disposed in flow communication therewith for the tangential injection of fluid into said chamber and the generation of a swirling flow therein.

13. The apparatus as set forth in claim 12 wherein said nozzles include a discharge member extending outwardly from said housing, said discharge member having an aperture formed therethrough adapted for the discharge of said swirling liquid jet.

14. A method of cutting a surface comprising the steps of:

providing a housing adapted to move against said surface;

providing fluid flow means into said housing;

providing at least one cylindrical chamber in said housing in flow communication with said fluid flow means;

centrally disposing a discharge tube in flow communication with said chamber;

injecting liquid into said chamber to generate a swirling flow therein;

disposing said discharge tube against the surface to be cut; and discharging said swirling flow from said chamber through said tube as a vortex jet stream while moving said housing thereagainst.

15. The method as set forth in claim 14 and further including steps of disposing said fluid flow means in tangential flow relationship with said chamber and tangentially injecting said liquid into said chamber for generating said swirling flow therein.

16. The method as set forth in claim 14 and further including the step of providing a wear button and securing said wear button to said housing in a position projecting outwardly therefrom, said wear button having an aperture formed therethrough and disposing said discharge tube in flow communication with said aperture of said wear button.

17. The method as set forth in claim 16 and further including the step of mechanically inducing fracture propagation of said surface by engagement thereof with said wear button.

18. The method as set forth in claim 14 wherein said surface to be cut is an earthen formation at an end of a well bore.

19. The method as set forth in claim 18 wherein said housing comprises a jet drill bit disposed within said well bore and said step of discharging said swirling flow while moving said housing comprises the step of rotating said jet drill bit against said formation.

20. The method as set forth in claim 19 and further including the steps of providing a noise detection array for monitoring subsurface noises and the step of generating a tone with said swirling flow discharge from said jet drill bit within said well bore.

21. The method as set forth in claim 20 including the step of varying said tone by varying the flow of the fluid flowing through said chamber for enhancing the detection of seismic signals by said noise detection array.

22. An improved drill bit for the drilling of a bore hole from a well head, said drill bit being of the type wherein a liquid jet is discharged from said bit to create an eroded region in a formation within the bore hole, said improvement comprising:

a drill bit having a plurality of discharge nozzles disposed thereabout;

said discharge nozzles extending outwardly from said drill bit for engagement with said formation;

a generally cylindrical chamber disposed in flow communication within said nozzles;

means for creating a liquid swirl within said chamber; and means for discharging said liquid swirl from said chamber and through said nozzles against said bore hole for the erosion thereof.

23. The apparatus as set forth in claim 22 and further including a noise detection array disposed about said well head for monitoring subsurface noises.

24. The apparatus as set forth in claim 23 and further including means for varying the flow of the fluid flowing through said chamber for varying said tone and enhancing the detection of seismic signals by said noise detection array.

25. A method of generating data from a bore hole comprising steps of:

providing a jet bit adapted for the discharge of fluid therefrom during its positioning within a bore hole;

disposing said jet bit within said bore hole and discharging fluid therefrom for the generation of noise therein;

detecting said noise from said jet bit; and converting said noise into data.

26. The method as set forth in claim 25 wherein said jet bit is positioned within said bore hole intermediate of the top and bottom of said bore hole for the generation of data from select locations therein.

27. The met hod as set forth in claim 25 wherein fluid is discharged from said jet bit during the drilling of said bore hole, said jet bit noise comprising bore hole data.

28. The method as set forth in claim 27 wherein said bore hole data includes the positional coordinates of the end of said bore hole.

29. The method as set forth in claim 27 wherein said fluid jet is formed by the axial discharge of fluid from said jet bit.

30. The method as set forth in claim 27 wherein said fluid jet is formed by the swirling discharge of fluid from said jet bit.

31. The method as set forth in claim 30 wherein said swirling flow of fluid is generated by a tangential injection of fluid into a chamber disposed within said jet bit.

32. The method as set forth in claim 31 and further including the step of injecting an abrasive stream into said swirling flow for discharge from said bit within said bore hole.

33. The method as set forth in claim 30 wherein said swirling flow is generated by the passage of fluid across a stator disposed within said jet bit.

34. The method as set forth in claim 33 and further including the step of injecting an abrasive stream into said swirling flow for discharge from said bit within said bore hole.

35. A method of cutting a surface with a continuous high velocity liquid jet comprising the steps of:

providing means for generating a continuous, high velocity liquid jet;

providing a wear button adapted for engaging said surface for the erosion thereof;

forming an aperture through said wear button adapted for the discharge of said continuous, high velocity liquid jet therefrom;

discharging said continuous, high velocity liquid jet from said wear button aperture; and disposing said surface adjacent said wear button for engagement therewith and the erosion thereof by both contact of the wear button with the surface and contact of the high velocity liquid jet with the surface.

36. The method as set forth in claim 35 and further including the step of forming said liquid jet by tangential injection of liquid into a substantially cylindrical chamber disposed in flow communication with said wear button aperture.

37. The method as set forth in claim 35 and further including the step of forming said liquid jet by involuted injection of liquid into said chamber.

38. The method as set forth in claim 35 and further including the step of moving said wear button relative to said surface and providing mechanical cutters in association with said wear button for engaging said surface for the cutting thereof.

39. The method as set forth in claim 38 and further including the step of mechanically inducing fracture propagation of said solid surface with said wear button and said mechanical cutters.

40. The method as set forth in claim 39 and further including the steps of forming said wear button with a generally hemispherical nose adapted for mechanically abutting said solid surface and coating the surface of said wear button with layers of polycrystalline material one atop the other, said layers being of increasing degrees of hardness to provide an elastic transition from a more elastic inside layer to a harder outside layer adapted for engaging said surface for the cutting thereof.

41. The method as set forth in claim 40 and further including the step of introducing an abrasive stream into said swirling liquid jet.

42. The method as set forth in claim 41 and further including the step of providing a tubular member and axially disposing said tubular member within said wear button aperture for passage of said abrasive stream therein and subsequent discharge therefrom.

43. The method as set forth in claim 42 wherein said abrasive stream is liquid.

44. The method as set forth in claim 35 wherein said step of forming said liquid jet comprises the step of providing at least one axial stator and flowing said liquid over said axial stator to generate a high velocity, swirling liquid jet therefrom.

* * * * *